US008223167B2

(12) United States Patent
Ogino et al.

(10) Patent No.: US 8,223,167 B2
(45) Date of Patent: Jul. 17, 2012

(54) IMAGE PROCESSING APPARATUS AND IMAGE DISPLAYING DEVICE

(75) Inventors: Masahiro Ogino, Ebina (JP); Katsunobu Kimura, Yokohama (JP); Mitsuo Nakajima, Yokohama (JP); Gen Endou, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1162 days.

(21) Appl. No.: 12/011,084

(22) Filed: Jan. 23, 2008

(65) Prior Publication Data

US 2008/0180455 A1 Jul. 31, 2008

(30) Foreign Application Priority Data

Jan. 31, 2007 (JP) ..... 2007-021714

(51) Int. Cl.
*G09G 5/00* (2006.01)

(52) U.S. Cl. ..... 345/613; 345/611

(58) Field of Classification Search ..... 345/611, 345/613

See application file for complete search history.

(56) References Cited

U.S. PATENT DOCUMENTS

| | | | | |
|---|---|---|---|---|
| 2005/0219275 | A1* | 10/2005 | Kitaura | 345/690 |
| 2006/0045375 | A1* | 3/2006 | Okuno et al. | 382/266 |
| 2006/0066593 | A1* | 3/2006 | Anderson et al. | 345/204 |
| 2006/0257029 | A1* | 11/2006 | De Haan | 382/199 |
| 2009/0122197 | A1* | 5/2009 | Neal | 348/708 |
| 2010/0141677 | A1* | 6/2010 | Hunter | 345/613 |

FOREIGN PATENT DOCUMENTS

| | | |
|---|---|---|
| JP | 09-212131 | 8/1997 |
| JP | 2001-326812 | 11/2001 |
| JP | 2002543473 | 12/2002 |
| JP | 2005141209 | 6/2005 |
| JP | 2005316392 | 11/2005 |

* cited by examiner

*Primary Examiner* — Jeffrey Chow

(74) *Attorney, Agent, or Firm* — Kilpatrick Townsend & Stockton LLP

(57) ABSTRACT

An RGB signal from an input terminal is supplied to a triple over-sampling/sub-pixel control processing unit and a brightness signal generating circuit in which a brightness signal is generated. A brightness edge detection/judgment unit detects an edge from this brightness signal, judges the kind of the edge, fetches a coefficient select signal corresponding to the judgment result from a memory and supplies the signal to the control processing unit. A tap coefficient corresponding to this coefficient select signal is set in the control processing unit and a triple over-sampling processing is executed for each of RGB. For edge parts, R and B sub-pixels the timings of which are displaced by ±⅓ pixel from the input R and B sub-pixels and the pixel gravitys of which are displaced by ±⅓ or ±⅛ pixel in accordance with the kind of the edge are generated.

8 Claims, 12 Drawing Sheets

(a)

(b)

IMAGE PROCESSING APPARATUS AND IMAGE DISPLAYING DEVICE

INCORPORATION BY REFERENCE

The present application claims priority from Japanese application JP2007-021714 filed on Jan. 31, 2007, the content of which is hereby incorporated by reference into this application.

BACKGROUND OF THE INVENTION

This invention relates to an image displaying device constituting one pixel by three light emitting devices that respectively emit light of three primary colors of R (red), G (green) and B (blue), such as a PDP (Plasma Display Panel), an LCD (Liquid Crystal Display), an organic EL display, etc, and an image processing apparatus used for the image displaying device.

The image displaying devices such as the PDP, the LCD and the organic EL display the market of which has been expanding rapidly at present employ the construction in which the RGB three primary colors are used as the basic colors and one pixel is constituted by three RGB light emitting devices including one each of RGB.

Each RGB component constituting the pixel is ordinarily called "sub-pixel". Generally, each RGB pixel constituting the same pixel is the pixel having the same timing as shown in FIG. 15(*a*) but these pixels are arranged on a display screen of the image displaying device in the order of RGB in a transverse direction, that is, in a horizontal scanning direction, while being displaced by ⅓ pixel from one another as shown in FIG. 15(*b*).

In consequence, the R sub-pixel is displaced on the display screen by ⅓ pixel to the left with respect to the G pixel for each pixel (or in other words, its timing advances by ⅓ pixel) and the G pixel is displaced by ⅓ pixel to the right (or its timing delays by ⅓ pixel). Nonetheless, the image is as such displayed while position shift resulting from such an arrangement of the sub-pixels is not taken into consideration. As a result, resolution is limited to one pixel unit and a phenomenon in which an oblique line, for example, is displayed in a jaggy form (called "jaggy") occurs.

To cope with this problem, a technology that can display a continuous oblique line by controlling the pixels in a sub-pixel unit has been proposed in the past (refer to JP-A-2005-141209, for example).

The technology of JP-A-2005-141209 converts by an interpolation processing a pixel composed of RGB 1 pixel to an interpolated pixel composed of RGB 3 pixels in which RGB repeats three times to improve resolution of the interpolated pixel of such interpolated pixels, and executes a outline emphasis process to improve sharpness.

The technology can thus acquire images free from the occurrence of jaggy but having improved resolution and sharpness. However, it is known that color position shift of blue or red occurs at an edge portion at which the difference of brightness is great. To solve this problem, JP-A-2005-141209 executes a filter processing of the edge portion by LPF to shade off and improve the color position shift portion.

On the other hand, a technology for correcting color position shift at the edge portion has also been proposed (refer to JP-A-9-212131, for example).

On the other hand, the technology described in this reference generates sub-pixels for the R and B sub-pixels that are ahead of a G sub-pixel by ⅓ pixel and behind the G sub-pixel, respectively, by using an FIR (Finite Impulse Response) filter, and conducts image display by using these RB sub-pixels and the G sub-pixel that is not processed, and corrects color position shift at the edge portion.

Here, assuming that the R and B sub-pixels as the processing object are x(n), respectively, and N pieces of R and B sub-pixels ahead and behind these R and B sub-pixels are x(n−i), respectively, (where $-N \leqq i \leqq N$, N: positive integer) and $k_i$ is a tap coefficient of the FIR filter for the sub-pixel x(n−i), the technology acquires an output sub-pixel y(n) for the sub-pixel x(n) represented by the following expression from the FIR filter.

$$y(n) = \sum_{i=o}^{N-1} k_i \times x(n-i)$$

The output sub-pixel y(n) represents the value of a sub-pixel ahead or behind of the input sub-pixel x(n) by ⅓ pixel in accordance with the tap coefficient $k_i$.

In the prior art example, a sub-pixel R(−⅓) behind the sub-pixel R(0) by ⅓ pixel can be generated by setting $k_0$ and $k_1$ to $k_0$=⅔ and $k_1$=⅓, and a sub-pixel B(⅓) ahead of the sub-pixel B(0) by ⅓ pixel can be likewise generated by setting $k_{-1}$ and $k_0$ to $k_{-1}$=⅓ and $k_0$=⅔, respectively. Color position shift at the edge portion is corrected in this manner. Because a high range is cut off owing to the characteristics of the FIR filter, however, the technology of the second reference prevents cut-off of the high range and corrects color position shift by concentrating the value of the tap coefficient $k_i$ on $k_0$, that is, by making the value of the tap coefficient $k_0$ sufficiently greater than other tap coefficients so that the output pixels that are ahead or behind by ⅓ pixel can be formed almost fully by the input sub-pixels x(0).

SUMMARY OF THE INVENTION

The technology of JP-A-2005-141209 described above executes the pixel control in the sub-pixel unit (sub-pixel processing) to suppress the jaggy on the oblique line and to acquire the image having improved resolution and sharpness, and executes also the shade-off processing by the LPF to prevent color position shift at the edge portion. Therefore, the technology involves the problems in that such a shade-off processing spoils the effect of the sub-pixel processing and the merit of the sub-pixel processing cannot be fully exploited.

The technology of JP-A-9-212131 can prevent color position shift at the edge portion. The technology prevents color position shift by converting the R and B sub-pixels having the same timing as the G sub-pixel to the sub-pixels that are displaced by ⅓ pixel from the G sub-pixel, respectively, but the R and B sub-pixels converted to such positions hardly change from the R and B sub-pixels before conversion is made. Therefore, the jaggy is noticeable in the oblique line in the same way as explained with reference to FIG. 15.

In view of the problems described above, it is an object of the invention to provide an image processing apparatus and an image displaying device capable of achieving high resolution and reducing color position shift by a sub-pixel processing.

To accomplish the object described above, the invention provides an image processing apparatus for a displaying device in which three light emitting devices respectively emitting light of the RGB primary colors constitute one pixel, the image processing apparatus including an n-times over-sampling processing unit (where n is an integer of 3 or more) for executing an n-times over-sampling processing for each RGB sub-pixel, and a pixel controlling unit for reconstructing one original pixel from the RGB sub-pixels subjected to the n-times over-sampling processing.

In the image processing apparatus according to the invention, the sub-pixel controlling unit controls a pixel gravity position shift amount in a 1/n pixel unit in accordance with the RGB pixel subjected to the n-times over-sampling processing.

The image processing apparatus according to the invention is characterized by n=3.

The image processing apparatus according to the invention further includes an edge detection/judgment unit for detecting and judging an edge around a remarked pixel, wherein the n-times over-sampling processing unit adaptively switches a pixel gravity position shift amount in accordance with edge information detected and judged by the edge detection/judgment unit.

In the image processing apparatus according to the invention, the edge detection/judgment unit described above detects an edge between the remarked pixel and comparative pixels adjacent to, and on both sides of, the remarked pixel in the horizontal/vertical directions, and the kind of the edge is judged in accordance with the edge detected.

In the image processing apparatus according to the invention, the pixel gravity position shift amount in the n-times over-sampling processing unit is set to a small amount when the edge detection/judgment unit detects an edge between the remarked pixel and comparative pixels adjacent to, and on both sides of, the remarked pixel in the horizontal direction, and to a large amount when the edge detection/judgment units detects an edge between the remarked pixel and comparative pixel adjacent to the remarked pixel in the vertical direction and moreover an edge between the remarked pixel and at least one of the comparative pixels adjacent to the remarked pixel in the horizontal direction.

In the image processing apparatus according to the invention, the edge detection/judgment unit described above executes edge detection/judgment by using pixels of a brightness signal.

In the image processing apparatus according to the invention, the edge detection/judgment unit executes edge detection/judgment for each RGB signal.

In the image processing apparatus according to the invention, the edge detection/judgment unit executes detection of the existence/absence of an edge with a predetermined threshold value as a reference.

To accomplish the object described above, the invention provides an image processing apparatus for a displaying device in which three light emitting devices respectively emitting light of RGB primary colors constitute one pixel, the image processing apparatus including a sub-pixel controlling unit for controlling an image signal corresponding to each color for each RGB sub-pixel to control a pixel gravity position shift amount of one pixel, and an edge detecting unit for detecting an edge of an image, wherein the sub-pixel controlling unit changes a coefficient used for an over-sampling processing on the basis of an angle between a segment of the edge detected by the edge detecting unit and a line in a vertical direction or a horizontal direction.

In the image processing apparatus according to the invention, the sub-pixel controlling unit makes the pixel gravity position shift amount maximal when the angle between the segment of the edge and the line in the vertical or horizontal direction is about 45°, and makes the pixel gravity position shift amount minimal or 0 when the angle is 0°.

An image displaying device according to the invention has its feature in that it has the image processing apparatus described above mounted thereto.

The invention makes it possible to reduce color position shift resulting from an image interpolation processing (sub-pixel processing) in a sub-pixel unit while keeping high resolution of display brought forth by the sub-sample processing.

Other objects, features and advantages of the invention will become apparent from the following description of the embodiments of the invention taken in conjunction with the accompanying drawings.

DESCRIPTION OF THE EMBODIMENTS

Preferred embodiments of the invention will be hereinafter described with reference to the accompanying drawings.

The explanation will be based on the assumption that the image processing apparatus of each embodiment to follow is directed to, and used by, an image displaying device such as PDP, LCD, organic EL display, and so forth, each having a display panel the arrangement of sub-pixels of which is RGB. However, the image processing apparatus can be likewise applied to an image displace device of a display panel having an arrangement of BGR.

Figure 1:
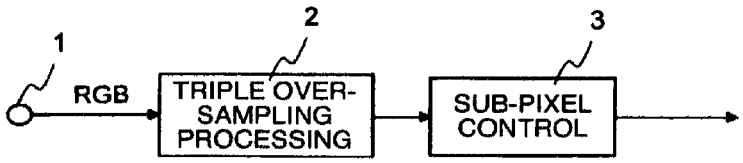
FIG. 1 is a block structural view of an image processing apparatus according to a first embodiment of the invention.

FIG. 1 is a block structural view showing an image processing apparatus according to a first embodiment of the invention. Reference numeral 1 denotes an input terminal of an RGB image signal, reference numeral 2 denotes a triple over-sampling processing unit and reference numeral 3 denotes a sub-pixel controlling unit.

In the drawing, an R signal constituted by R sub-pixels having a digital brightness value, a G signal constituted by G sub-pixels having a digital brightness value and a B signal constituted by B sub-pixels having a digital brightness value are inputted from the input terminal 1 and are supplied to the triple over-sampling processing unit 2. The RGB sub-pixels forming the same pixel in these RGB signals are supplied at the same timing to the triple over-sampling processing unit as shown in FIG. 2(*a*).

The triple over-sampling processing unit 2 over-samples the RGB sub-pixels at a clock having a cycle of ⅓ times the pixel cycle (hereinafter called "⅓ pixel clock") in synchronism with the clock of the pixel cycle (hereinafter called "pixel clock"), and generates an R sub-pixel having a brightness value at a position that is ahead by one cycle of this ⅓ pixel clock for the G sub-pixel (hereinafter called "R sub-pixel having gravity position ahead by ⅓ pixel") and a B sub-pixel that is behind by one cycle of the ⅓ pixel clock (hereinafter called "B sub-pixel having gravity position behind by ⅓ pixel").

Figure 2:
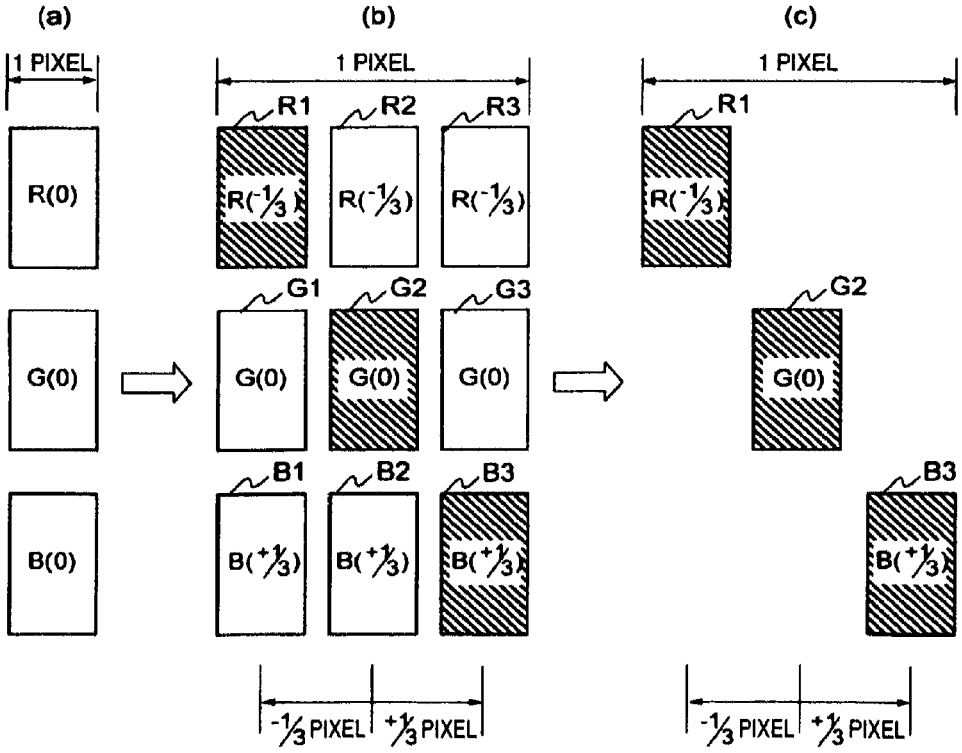
FIG. 2 schematically shows the flow of processing in the first embodiment shown in FIG. 1.

FIG. 2(*b*) shows the R sub-pixel having the gravity position ahead by ⅓ pixel and the B sub-pixel having the gravity position behind by the ⅓ pixel, which are generated by the triple over-sampling processing unit 2.

Assuming that the RGB sub-pixels in the same pixel shown in FIG. 2(*a*) are R(0), G(0) and B(0), these sub-pixels are the sub-pixels at the same timing but when they are subjected to the later-appearing triple over-sampling processing in the triple over-sampling unit 2, there are generated for each ⅓ pixel clock an R sub-pixel having a gravity position ahead by ⅓ pixel (hereinafter called "R(−⅓) sub-pixel") and a B sub-pixel having a gravity position behind by ⅓ pixel (hereinafter called "B(+⅓) sub-pixel"). As for the G sub-pixel, the G(0) sub-pixel inputted is generated as G(0) sub-pixel as it is for each ⅓ pixel clock.

Assuming that three G(0) sub-pixels for each ⅓ pixel inside the same pixel are G1, G2 and G3 sub-pixels in accordance with the order of their arrangement, the G sub-pixel is coincident with the timing of the ⅓ pixel clock at the center in the pixel, the G1 pixel is coincident with the timing of the ⅓ pixel clock that is ahead by one ⅓ pixel of this pixel center, and the G3 sub-pixel is coincident with the timing of the ⅓ pixel clock that is behind by one ⅓ pixel of the ⅓ pixel of this pixel center. In other words, the timing of the G1 sub-pixel is ahead by ⅓ pixel of the G2 sub-pixel and the timing of the G3 sub-pixel is behind the G2 sub-pixel by ⅓ pixel.

Similarly, assuming that three R(−⅓) sub-pixels for each ⅓ pixel clock inside the same pixel are R1, R2 and R3 sub-pixels in the order of their arrangement, these sub-pixels have the same brightness value and the timing of the R2 sub-pixel is coincident with the timing of the ⅓ pixel clock at the center inside the pixel, that is, the G2 sub-pixel. The timing of the R1 sub-pixel is coincident with the timing of the G1 sub-pixel. Therefore, it is the sub-pixel the timing of which is ahead by ⅓ pixel of the R2 sub-pixel. The timing of the R3 sub-pixel is coincident with the G3 sub-pixel. Therefore, it is the sub-pixel the timing of which is behind the R2 sub-pixel by ⅓ pixel.

Similarly, assuming further that three B(+⅓) sub-pixels for each ⅓ pixel clock inside the same pixel are B1, B2 and B3 sub-pixels in the order of their arrangement, these sub-pixels have the same brightness value and the timing of the B2 sub-pixel is coincident with the timing of the ⅓ pixel clock at the center inside the pixel, that is, the timing of the G2 sub-pixel. The timing of the B1 sub-pixel is coincident with the timing of the G1 sub-pixel. Therefore, it is the sub-pixel the timing of which is ahead of the B2 sub-pixel by ⅓ pixel. The timing of the B3 sub-pixel is coincident with the G3 sub-pixel. Therefore, it is the sub-pixel the timing of which is behind the B2 sub-pixel by ⅓ pixel.

Referring to FIG. 1, these RGB sub-pixels outputted from the triple over-sampling processing unit 2 are supplied to the sub-pixel controlling unit 3. The sub-controlling unit 3 extracts an optimal RGB sub-pixel from the RGB sub-pixels after the triple over-sampling processing shown in FIG. 2(*b*) are made for each pixel.

In FIG. 2(*b*), the R1 sub-pixel is the sub-pixel the timing of which is ahead by ⅓ pixel of the G2 sub-pixel having the timing of the ⅓ pixel clock at the center inside the pixel. It is also the sub-pixel the gravity position of which is ahead by ⅓ pixel of the R sub-pixel having the same timing as the G2 sub-pixel (R(0) sub-pixel in FIG. 2(*a*)). Therefore, this R1 sub-pixel is the sub-pixel existing at the correct timing position with respect to the G2 sub-pixel among the R1, R2 and R3 sub-pixels. Similarly, the B3 sub-pixel the timing of which is behind by ⅓ pixel the B sub-pixel having the same timing as the G2 sub-pixel (B(0) sub-pixel in FIG. 2(*a*)) is the sub-pixel existing at the correct timing position with respect to the G2 sub-pixel.

The sub-pixel control unit 3 shown in FIG. 1 extracts the R1, G2, B3 sub-pixels among the RGB sub-pixels subjected to the triple over-sampling processing as shown in FIG. 2(*c*) and this control processing is executed for each pixel. The RGB sub-pixels outputted from the pixel controlling unit 3 are used for display in the display panel, not shown in the drawing.

Figure 3:
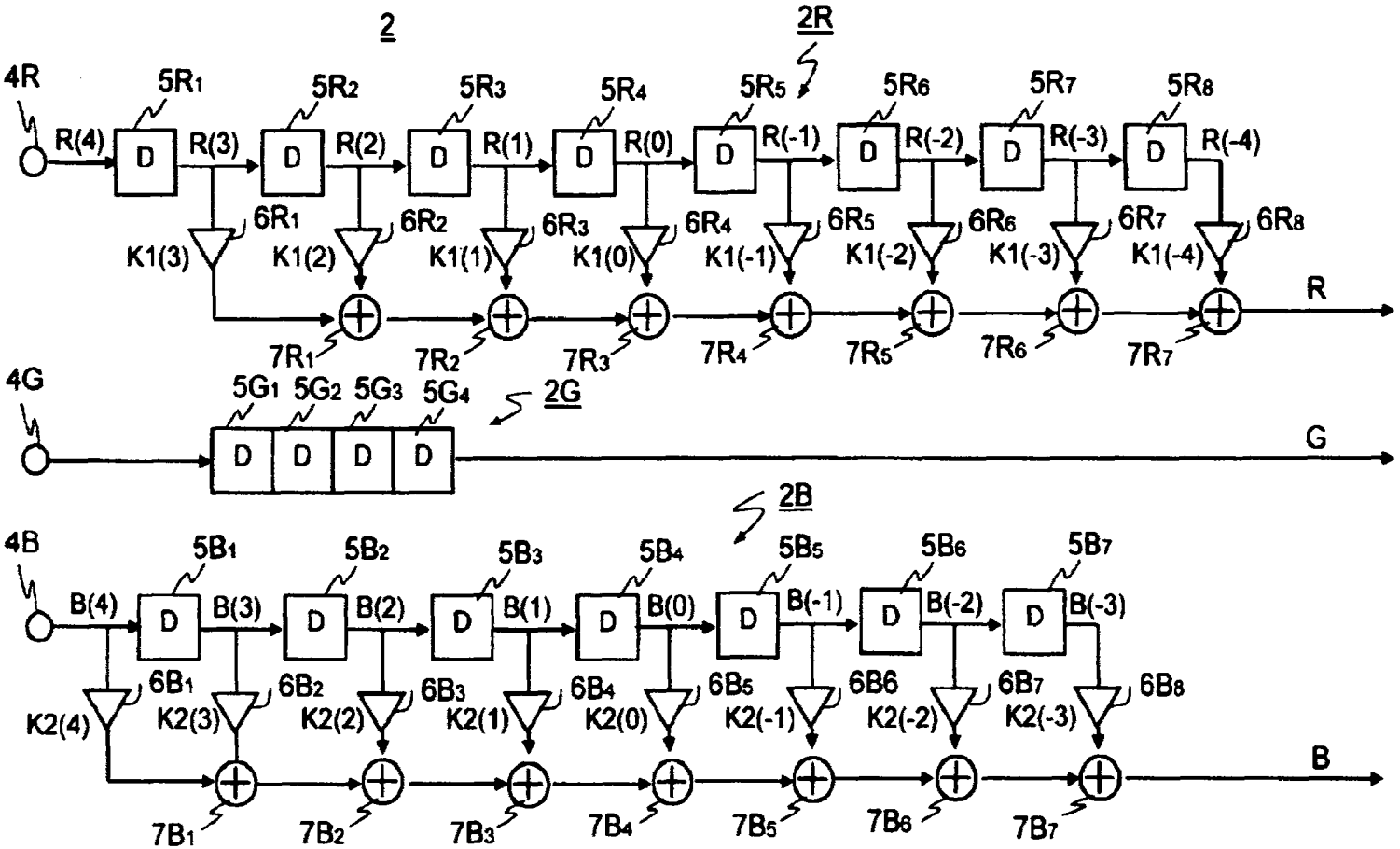
FIG. 3 is a circuit diagram showing a concrete example of a triple over-sampling processing unit shown in FIG. 1.

FIG. 3 is a circuit diagram showing a concrete example of the triple over-sampling unit 2 shown in FIG. 1. Reference numerals 2R, 2G and 2B denote triple over-sampling processing units for RGB, respectively. Reference numerals 4R, 4G and 4B denote input terminals. Reference numerals $\mathbf{5}R_1$ to $\mathbf{5}R_8$, $\mathbf{5}G_1$ to $\mathbf{5}G_4$ and $\mathbf{5}B_1$ to $\mathbf{5}B_7$ denote delay devices. Reference numerals $\mathbf{6}R_1$ to $\mathbf{6}R_8$ and $\mathbf{6}B_1$ to $\mathbf{6}B_8$ denote multipliers. Reference numerals $\mathbf{7}R_1$ to $\mathbf{7}R_7$ and $\mathbf{7}B_1$ to $\mathbf{7}B_7$ denote adders.

In the drawing, the triple over-sampling processing unit 2 include a triple over-sampling processing unit 2R for executing triple over-sampling processing of R sub-pixels, a triple over-sampling processing unit 2G for processing G sub-pixels and a triple over-sampling processing unit 2B for processing B sub-pixels. An R sub-pixel is inputted from the input terminal 4R to the triple over-sampling processing unit 2R, a G sub-pixel is inputted from the input terminal 4G to the triple over-sampling processing unit 2G and a B sub-pixel is inputted from the input terminal 4B to the triple over-sampling processing unit 2B. These input operations are made simultaneously with one another. The RGB sub-pixels so inputted are over-sampled triple by the ⅓ pixel clocks that are synchronous with one another inside a sampling circuit not shown in the drawing. Therefore, the same pixel is arranged in the ⅓ pixel cycle in each pixel.

The triple over-sampling processing unit 2R includes eight delay devices $\mathbf{5}R_1$ to $\mathbf{5}R_8$ for serially delaying the R sub-pixels, that are subjected to triple over-sampling and inputted from the input terminal 4R, by one pixel cycle, eight multipliers $\mathbf{6}R_1$ to $\mathbf{6}R_8$ for multiplying the R sub-pixels from the delay devices $\mathbf{5}R_1$ to $\mathbf{5}R_8$ by a tap coefficient K1(*n*) and seven adders $\mathbf{7}R_1$ to $\mathbf{7}R_7$ for serially adding the outputs of these multipliers, and constitutes an FIR filter having 8 taps.

Each delay device $\mathbf{5}R_1$ to $\mathbf{5}R_8$ delays the R sub-pixel supplied by one pixel cycle. Assuming that the R sub-pixel inputted from the input terminal 4R and subjected to triple over-sampling is R(4) of a certain pixel (that includes three same R sub-pixels; hereinafter the same), the delay device $\mathbf{5}R_1$ outputs an R(3) sub-pixel of the pixel immediately before R(4), the delay device $5R_2$ outputs an R(2) sub-pixel of the pixel ahead of R(4) by 2 pixels, the delay device $5R_4$ outputs an R(0) sub-pixel of the pixel ahead of R(4) by 4 pixels, . . . , the delay device $5R_8$ outputs an R(−4) sub-pixel of the pixel ahead of R(4) by 8 pixels. The R(3), R(2), . . . , R(0), . . . , R(−4) sub-pixels outputted from these delay devices $5R_1$ to $5R_8$ are multiplied by the tap coefficients K1(3), K1(2), . . . , K1(0), . . . , K1(−4), respectively, by the corresponding multipliers $6R_1$, $6R_2$, . . . , $6R_4$, . . . , $6R_8$ and are then added with one another by the adders $7R_1$ to $7R_7$. Consequently, three R(+⅓) sub-pixels having the +⅓ pixel interval for each pixel can be obtained from the triple over-sampling processing unit 2R as shown in FIG. 2(*b*).

Let's assume hereby that n is an integer, the R sub-pixel of the n-th pixel (that is, R sub-pixel outputted from the n-th delay device $5R_n$) is R(n) and the tap coefficient multiplied to this R(n) sample pixel is K1(*n*), the triple over-sampling processing unit 2R conducts the operation of the following $$R(-1/3) = \sum_n K1(n) \times R(n) \tag{1}$$

In the construction shown in FIG. 3, n is an integer satisfying the relation −4≦n≦3.

This R(+⅓) sub-pixel is the R sub-pixel in one pixel cycle including R1, R2 and R3 sub-pixels shown in FIG. 2(*b*). Therefore, each of the delay devices $5R_1$ to $5R_8$ inputs the R sub-pixel of triple over-sampling supplied in synchronism with the ⅓ pixel clock that is in synchronism with the pixel, delays the R sub-pixel by one pixel cycle and outputs the R sub-pixel. In this way, each delay device $5R_1$ to $5R_8$ outputs the R sub-pixels that are subjected to triple over-sampling and are delayed by one pixel cycle.

The R1, R2 and R3 sub-pixels having the same brightness value and shown in FIG. 2(*b*) can be obtained for each pixel as the output R sub-pixel from each delay device $5R_1$ to $5R_8$ is subjected to the operation of the formula (1) given above.

The triple over-sampling processing unit 2B includes seven delay devices $5B_1$ to $5B_7$ for serially delaying the B sub-pixels, that are inputted from the input terminal 4B and subjected to triple over-sampling, by one pixel cycle, eight multipliers $6B_1$ to $6B_8$ for multiplying the B sub-pixels from the delay devices $5B_1$ to $5B_7$ by a tap coefficient K1(*n*) and seven adders $7R_1$ to $7R_7$ for serially adding the outputs of these multipliers, and constitutes an FIB filter having 8 taps.

Each delay device $5B_1$ to $5B_7$ delays the B sub-pixel supplied by one pixel cycle. Assuming that the B sub-pixel inputted from the input terminal 4B and subjected to triple over-sampling is B(4) of a certain pixel (that includes three same B sub-pixels; hereinafter the same), the delay device $5B_1$ outputs an B(3) sub-pixel of the pixel immediately before B(4), the delay device $5B_2$ outputs a B(2) sub-pixel of the pixel ahead of B(4) by 2 pixels, the delay device $5R_4$ outputs a B(0) sub-pixel of the pixel ahead of B(4) by 4 pixels, . . . , the output device $5R_7$ outputs a B(−3) sub-pixel of the pixel ahead of B(4) by 7 pixels. The B(3), B(2), . . . , B(0), . . . , R(−3) sub-pixels outputted from these delay devices $5B_1$ to $5B_7$ are multiplied by the tap coefficients K2(3), K2(2), . . . , K2(0), . . . , K2(−3), respectively, by the corresponding multipliers $6B_2$, . . . , $6B_4$, . . . , $6B_8$ and are then added with one another by the adders $7B_1$ to $7B_7$. Consequently, three B(+⅓) sub-pixels having the +⅓ pixel interval for each pixel can be obtained from the triple over-sampling processing unit 2B as shown in FIG. 2(*b*).

Let's assume hereby that the B sub-pixel of the n-th pixel (that is, B sub-pixel outputted from the n-th delay device 5Bn) is B(n) with n being an integer and the tap coefficient multiplied to this R(n) sample pixel is K2(*n*), the triple over-sampling processing unit 2B conducts the operation of the following $$B(+1/3) = \sum_n K2(n) \times B(n) \tag{2}$$

In the construction shown in FIG. 3, n is an integer satisfying the relation −4≦n≦3.

This B(+⅓) sub-pixel is the B sub-pixel in one pixel cycle including B1, B2 and B3 sub-pixels shown in FIG. 2(*b*). Therefore, each of the delay devices $5B_1$ to $5B_7$ serially inputs the B sub-pixels of triple over-sampling supplied in synchronism with the ⅓ pixel clock that is in synchronism with the pixel, delays the B sub-pixel by one pixel cycle and outputs the B sub-pixel. In this way, each delay device $5B_1$ to $5B_7$ outputs the B sub-pixels that are subjected to triple over-sampling and are delayed by one pixel cycle.

The B1, B2 and B3 sub-pixels having the same brightness value and shown in FIG. 2(*b*) can be obtained for each pixel as the output B sub-pixel from each delay device $5B_1$ to $5B_7$ is subjected to the operation of the expression (2).

The triple over-sampling processing unit 2G includes four delay devices $5G_1$ to $5G_4$ having a delay amount for one pixel cycle in the same way as the delay devices $5R_1$ to $5R_8$ and $5B_1$ to $5B_7$ and the G sample pixels subjected to tripe over-sampling and delayed by four pixel cycles can be obtained from the input terminal 4G. The G sub-pixel so outputted includes three sub-pixels of G1, G2 and G3 for each pixel shown in FIG. 2(*b*) and when the G sub-pixel is inputted from the input terminal 4G, its timing is coincident with the timings of the R(0) sub-pixel and B(0) sub-pixel inputted simultaneously from the input terminals 4R and 4B and outputted from the delay devices $5R_4$ and $5B_4$, respectively.

In the sub-pixel controlling unit 3 shown in FIG. 1, the G sub-pixel outputted from the triple over-sampling processing unit 2G is fetched at a timing of ⅓ pixel in synchronism with the pixel clock and the G(0) sub-pixel shown in FIG. 2(*b*) is extracted for each pixel. The R sub-pixel is fetched from the triple over-sampling processing unit 2R at a timing of the ⅓ pixel clock that is ahead of the G(0) sub-pixel by one cycle (⅓ pixel) to give an R pixel whose gravity position at the timing position ahead of the G(0) sub-pixel by ⅓ pixel is ahead by 1/m pixel (m>1; when m=3, for example, R1 sub-pixel among the R(−⅓) sub-pixels in FIG. 2(*c*)). The B sub-pixel outputted from the triple over-sampling processing unit 2B is fetched at a timing of ⅓ pixel behind by one cycle (⅓ pixel) the pixel clock and a B pixel whose gravity position at the timing position behind by ⅓ pixel the G(0) sub-pixel clock is behind by 1/m pixel (when m=3, for example, B3 sub-pixel among the B(+⅓) sub-pixels in FIG. 2(*c*)).

The following Table 1 tabulates a concrete example of tap coefficients K1(*n*) and K2(*n*) of the multipliers $6R_1$ to $6R_8$ and $6B_1$ to $6B_8$ when R(−⅓) and B(+⅓) sub-pixels are generated from the RGB sub-pixels inputted from the input terminals 4R, 4G and 4B.

TABLE 1

| n | K1 (n) | k2 (n) | K3 (n) |
|---|---|---|---|
| −4 | −0.06 | — | 0 |
| −3 | 0.08 | −0.04 | 0 |
| −2 | −0.2 | 0.09 | 0 |
| −1 | 0.5 | −0.1 | 0 |
| 0 | 0.7 | 0.7 | 1 |
| 1 | −0.1 | 0.5 | 0 |
| 2 | 0.09 | −0.2 | 0 |
| 3 | −0.04 | 0.08 | 0 |
| 4 | — | −0.06 | 0 |

Incidentally, a tap coefficient K3(*n*) in Table 1 assumes a tap coefficient for the G sub-pixels and K3(0)=1 and other tap coefficients K3(*n*)=0. This means that the G sub-pixel is as such outputted as in the triple over-sampling processing unit 2G.

According to Table 1, the value of the tap coefficient K1(*n*) used for the processing of the R sub-pixels concentrates on the R(−1) sub-pixel of the pixel directly before the R sub-pixel together with the tap coefficient K1(0) of the R(0) sub-pixel, and is also dispersed to the tap coefficients of other R(04) to R(−2) and R(1) to R(3) sub-pixels though the values are small. Therefore, an R(−⅓) sub-pixel the gravity position of which is ahead of the R(0) sub-pixel by ⅓ pixel clock, that is, by ⅓ pixel cycle, can be obtained.

Similarly, the value of the tap coefficient K2(*n*) used for the processing of the B sub-pixels concentrates on the B(−1) sub-pixel of the pixel directly behind together with the tap coefficient K2(0) of the B(0) sub-pixel, and is also dispersed to the tap coefficients of other B(−3) to B(−1) and B(2) to B(4) sub-pixels though the values are small. Therefore, a B(+⅓) sub-pixel the gravity position of which is behind the B(0) sub-pixel by ⅓ pixel clock, that is, by ⅓ pixel cycle, can be obtained.

Additionally, the value of the tap coefficient K1(*n*) and that of the tap coefficient K1(0) have an inversion relationship of the order.

Figure 4:
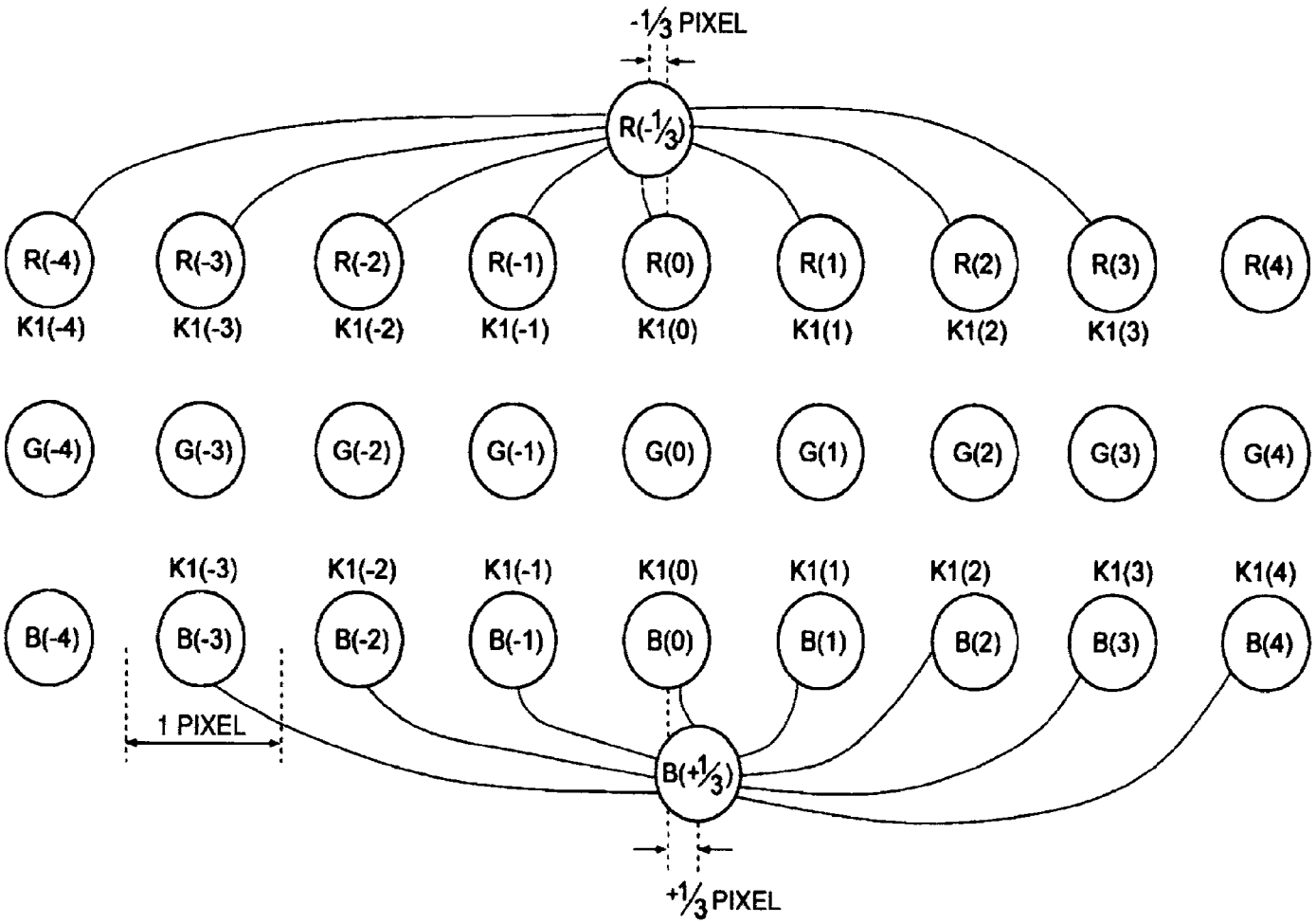
FIG. 4 schematically shows the processing operation of the triple over-sampling processing unit shown in FIG. 3.

FIG. 4 schematically shows the processing operations of the triple over-sampling operations in FIG. 1 described above.

In the drawing, the tap coefficient K1(*n*) is the one shown in Table 1 and the triple over-sampling processing unit 2R multiplies the R(−3) sub-pixel by the tap coefficient K1(−3), the R(−2) sub-pixel by the tap coefficient K1(−2), the R(−1) sub-pixel by the tap coefficient K1(−1), the R(0) sub-pixel by the tap coefficient K1(0), the R(1) sub-pixel by the tap coefficient K1(1), the R(2) sub-pixel by the tap coefficient K1(2) and R(3) sub-pixel by the tap coefficient K1(3). All the products are added and are processed by the sub-pixel controlling unit 3 to generate an R(−⅓) sub-pixel at a timing position ahead of the G(0) sub-pixel by ⅓ pixel. The triple over-sampling processing unit 2B multiplies the B(−4) sub-pixel inputted by the tap coefficient K2(−4), the B(−3) sub-pixel by the tap coefficient K2(−3), the B(−2) sub-pixel by the tap coefficient K2(−2), the B(−1) sub-pixel by the tap coefficient K2(−1), the B(0) sub-pixel by the tap coefficient K2(0), the B(1) sub-pixel by the tap coefficient K2(1), the B(2) sub-pixel by the tap coefficient K2(2) and the B(3) sub-pixel by the tap coefficient K2(3). All the products are added and are processed by the sub-pixel controlling unit 3 to generate an B(+⅓) sub-pixel at a timing position ahead of the G(0) sub-pixel by ⅓ pixel.

Figure 5:
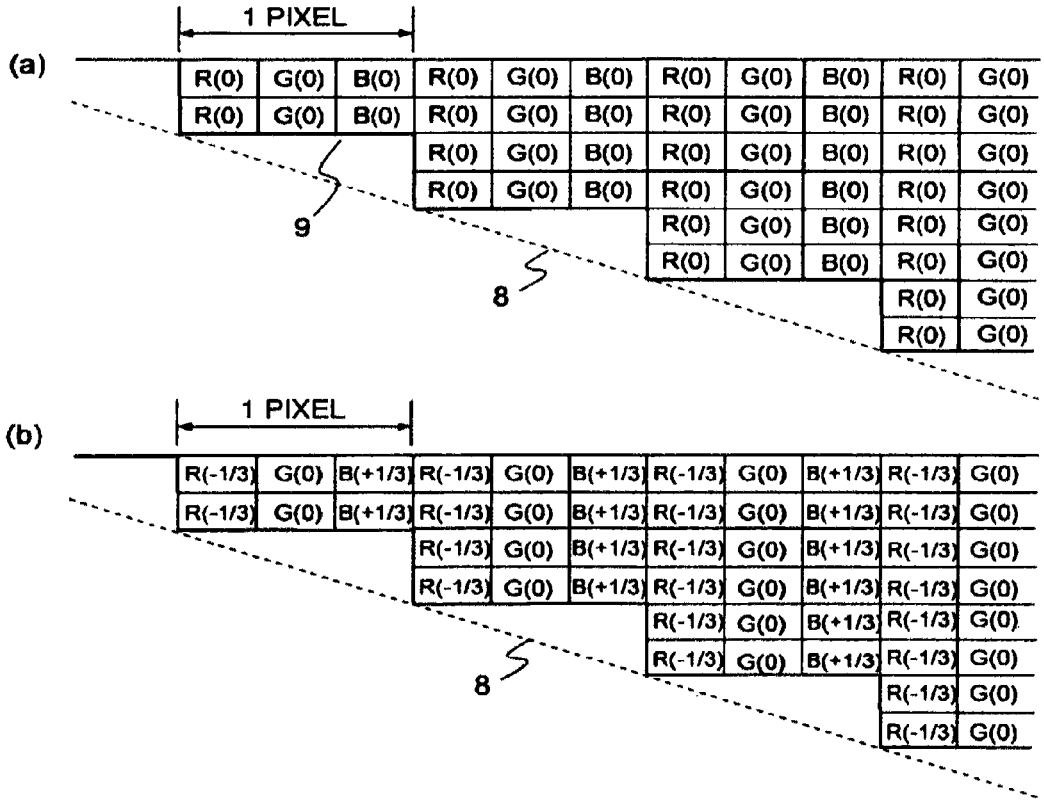
FIG. 5 schematically shows an oblique edge portion of a display image.
Figure 15:
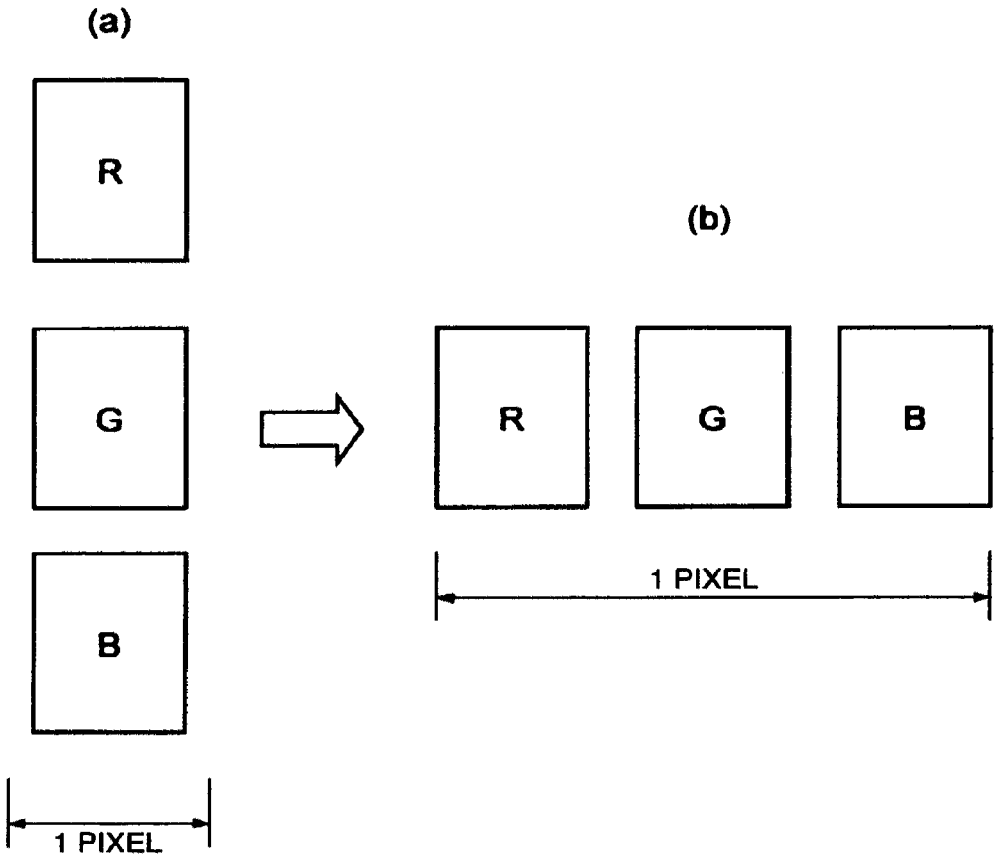
FIG. 15 shows a prior art example of an arrangement method of RGB sub-pixels for display.

FIG. 5 schematically shows the oblique edge portion of the display image. FIG. 5(*a*) shows the case where image display is made by arranging the sub-pixels in the arrangement shown in FIG. 15 and FIG. 5(*b*) shows the case where the sub-pixels are generated in the first embodiment in the manner described above and image display is made.

Referring to FIG. 5(*a*), when the RGB sub-pixels inputted are as such arranged in match with the display panel, the R(0) and B(0) sub-pixels are not positioned to the original positions but undergo position shift by ⅓ pixel at the portions of the oblique edges 8. Therefore, the difference becomes remarkable between the pixel keeping touch with one of the sides of the oblique edge 8 and the pixel on the opposite side (not shown) at the portion of the oblique edge 8, and the boundary between these pixels becomes noticeable. Consequently, even when the oblique edge 8 is straight line, the boundary 9 of such pixels looks as the edge and a jaggy edge, that is, jaggy 9, appears.

In this first embodiment shown in FIG. 5(*b*), on the other hand, even when the RGB sub-pixels have the same arrangement as in FIG. 5(*a*), the gravity position of the R sub-pixel in this case is in conformity with the timing position of the R sub-pixel with respect to the G(0) sub-pixel. In other words, the brightness value is closer to the R sub-pixel on the opposite side to the oblique edge 8. Consequently, the difference between the pixels with the oblique edge 8 as the boundary can be mitigated, the jaggy becomes smooth and the oblique edge appears like a straight line.

Incidentally, though the edge is hereby a rightward down edge, the explanation holds true as such of a leftward down edge. Since the B sub-pixel of each pixel is the B(⅓) sub-pixel that is in conformity with its timing position, the jaggy can be mitigated.

In this first embodiment, the arrangement sequence of the sub-pixels on the display panel is RGB. In the case of BGR, however, the triple over-sampling processing unit 2R in FIG. 3 may be changed to the triple over-sampling processing unit 2B for processing the B sub-pixels and the triple over-sampling processing unit 2B, to the triple over-sampling processing unit 2R for processing the R sub-pixels. This also holds true of the embodiments that follow. Furthermore, the tap coefficients K1(*n*) and K2(*n*) used in the triple over-sampling processing unit 2 are not limited to the values shown in Table 1 but can be set to appropriate values. Consequently, the pixel gravity position shift amounts of the R and B sub-pixels the timing positions of which are displaced with respect to the G sub-pixels can be made changeable and images having high resolution can be acquired in accordance with the features of the images to be displayed and with the sub-pixel displaying method of the display panel.

In the first embodiment described above, the R and B sub-pixels are the sub-pixels the pixel gravity positions of which are displaced by ±⅓ pixel at the position deviated by the ±⅓ pixel cycle with respect to the G sub-pixel. This construction is effective for reducing the jaggy phenomenon of the oblique line (edge) and when an edge 10 in a longitudinal direction exists on the display image as shown in FIG. 6(*a*), color position shift occurs from time to time along this edge.

Figure 6:
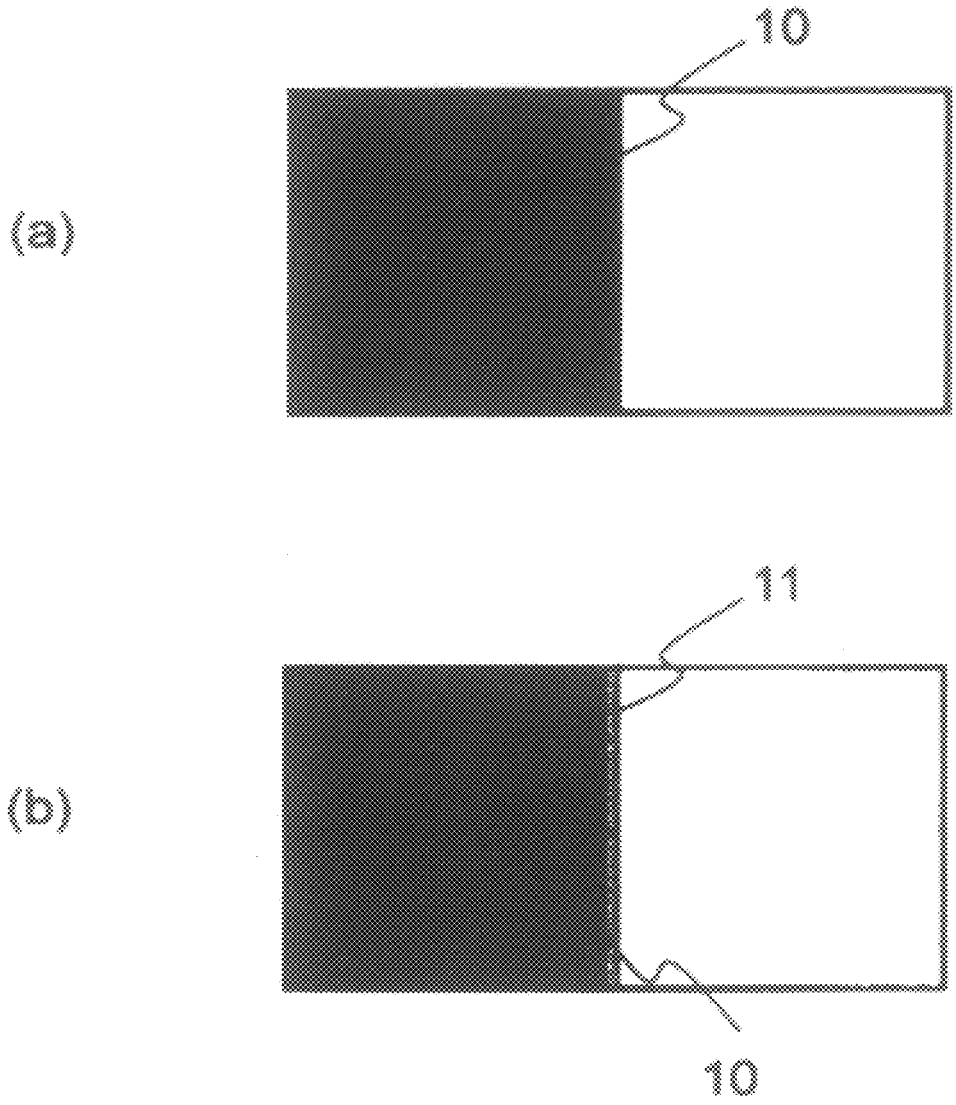
FIG. 6 shows a false color at an edge in a longitudinal direction.

FIG. 6(*b*) shows a false color. It will be assumed hereby that an image having a white region on the right side and a black region on the left side with the edge 10 in the longitudinal direction being the boundary is formed on the display screen. Then, a blue line 11 appears along the edge 10 in the white region. Assuming that an image having a black region on the right side and a white region on the left side is formed on the display screen, on the contrary, a red line appears along the edge in the white region.

Such a false color will be explained with reference to FIG. 7. It will be assumed that the right side is the white region and the left side, the black region with the edge 10 in the longitudinal direction being the boundary. The pixel 12 adjacent to this edge 10 is affected by the brightness value of the R sub-pixel of the pixel adjacent left to the extreme left R(−⅓) sub-pixel (that is, the pixel keeping touch with the edge 10 in the black region 10). Therefore, it is an R sub-pixel having a small brightness value. In contrast, the B(+⅓) sub-pixel of this pixel 12 is affected by the brightness value of the B sub-pixel of the pixel of the same white region adjacent on the right side and has a large brightness value. Therefore, this pixel 12 is greatly affected by the B(+⅓) sub-pixel and displays a bluish color. In consequence, a bluish line 11 appears along the edge 10 in the longitudinal direction as shown in FIG. 6(*b*). Similarly, when an edge in the longitudinal direction with the white region on the left and the black region on the right exists, color position shift occurs in which a reddish line appears along the edge because the brightness value of the B(+⅓) sub-pixel is small. When an enhancer processing of the image is executed in a post stage, this color position shift becomes all the more remarkable.

Incidentally, the above explains the case where the arrangement sequence of the sub-pixels on the display panel has the sequence of RGB. In the case of BGR, however, a reddish color line appears along the edge when the right side is a white region and the left side is a black region and a bluish color line appears along the edge when the left side is the white region and the right side is the black region.

The second embodiment that can suppress such color position shift will be hereinafter explained.

Figure 8:
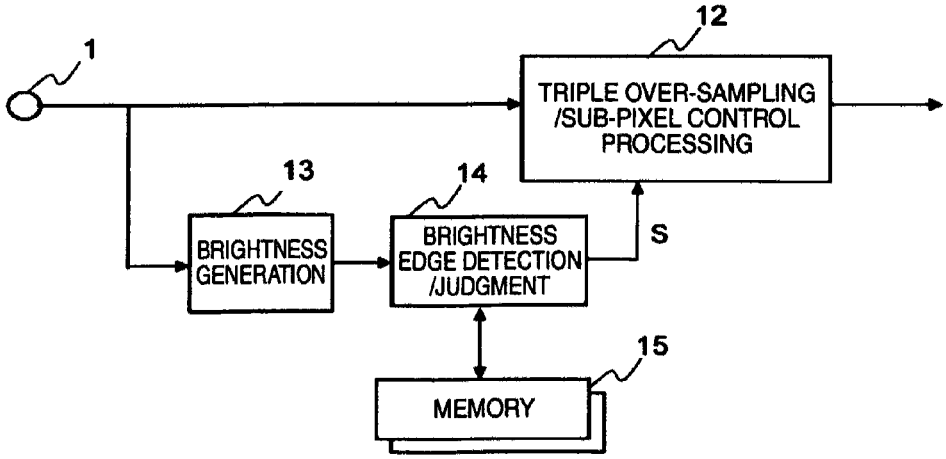
FIG. 8 is a block structural view of an image processing apparatus according to a second embodiment of the invention.

FIG. 8 is a block structural view showing an image processing apparatus according to the second embodiment of the invention. Reference numeral 1 denotes an input terminal of an RGB image signal. Reference numeral 12 denotes a triple over-sampling/sub-pixel control processing unit. Reference numeral 13 denotes a brightness signal generating unit. Reference numeral 14 denotes a brightness edge detection judgment unit. Reference numeral 15 denotes an image memory.

In the drawing, the triple over-sampling/sub-pixel control processing unit 12 has the construction shown in FIG. 1. However, in the triple over-sampling processing unit 2 (FIG. 1) in this triple over-sampling/sub-pixel control processing unit 12, the tap coefficients K1(*n*) and K2(*n*) used for the triple over-sampling processing and shown in FIG. 3 are variable. In this second embodiment, the tap coefficient used for the over-sampling processing is adaptively switched in accordance with the edge information of the RGB input signal inputted from the input terminal 1. In consequence, the false color that occurs in the edge in the longitudinal direction can be reduced while the effect of the apparent high resolution owing to the image interpolation processing in the sub-pixel unit is maintained.

When the edge is the oblique line as described above, the R(+⅓) sub-pixel the timing position of which is ahead by ⅓ pixel with respect to the G(0) sub-pixel and the B(−⅓) sub-pixel the timing position of which is behind by ⅓ pixel are generated by setting the tap coefficients K1(*n*) and K2(*n*) as tabulated in Table 1, and the tap coefficients K1(*n*) and K2(*n*) are set for the edge in the longitudinal direction as tabulated in Table 2.

TABLE 2

| n | K1 (n) | k2 (n) | K3 (n) |
|---|---|---|---|
| −4 | −0.01 | — | 0 |
| −3 | 0.02 | −0.01 | 0 |
| −2 | −0.08 | 0.02 | 0 |
| −1 | 0.1 | −0.04 | 0 |

TABLE 2-continued

| n | K1 (n) | k2 (n) | K3 (n) |
|---|---|---|---|
| 0 | 0.95 | 0.95 | 1 |
| 1 | −0.04 | 0.1 | 0 |
| 2 | 0.02 | −0.08 | 0 |
| 3 | −0.01 | 0.02 | 0 |
| 4 | — | −0.01 | 0 |

In this case, the values of the tap coefficients K1(*n*) and K2(*n*) concentrate on K1(0) and K2(0) much more than in Table 1 and the values dispersed to the tap coefficients K1(*n*) and K2(*n*) other than these tap coefficients K1(0) and K2(0) are smaller. The R and B sub-pixels the timing position of which is deviated by ⅓ pixel from the G(0) sub-pixel obtained from the triple over-sampling processing unit 2 (FIG. 3) in the triple over-sampling/sub-pixel control processing unit 12 are the sub-pixels that have brightness values more approximate to the original R(0) and B(0) sub-pixels (FIG. 2(*a*)) than the R(−⅓) sub-pixel and the B(+⅓ pixel), that is, the sub-pixels having smaller pixel gravity position shift amounts. In the case of the tap coefficients K1(*n*) and K2(*n*) shown in Table 2, the pixel gravity position shift amount is approximately ⅛ pixel and such R and B sub-pixels will be hereinafter called "R(−⅛) sub-pixel" and "B(+⅛) sub-pixel".

Figure 7:
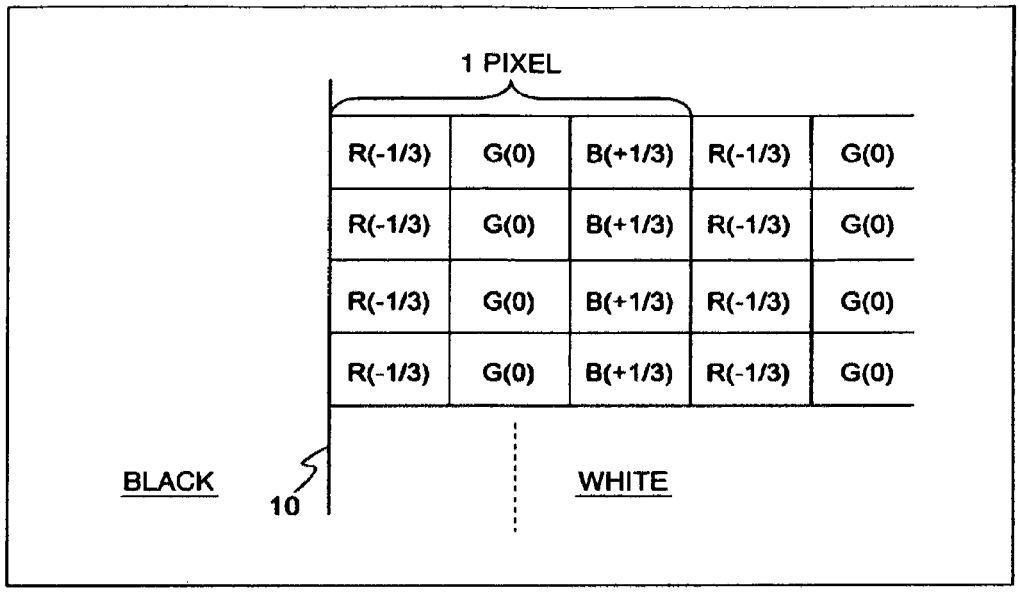
FIG. 7 is an explanatory view for explaining the false color shown in FIG. 6.

When the pixel gravity position shift amount is reduced in this way, the brightness amount of the R(−⅓) pixel becomes greater in the pixels keeping touch with the edge 10 in the white region in FIG. 7. Therefore, the color position shift shown in FIG. 6 is reduced and is not recognized. In this case, when the pixel gravity position shift amount is decreased, the jaggy improving effect for the oblique edge is reduced quite naturally. In other words, the color position shift and the jaggy improving effect have a trade-off relation. However, the jaggy does not occur in the longitudinal line edge pattern shown in FIG. 5. Therefore, correction by the pixel gravity position shift may well be minimal. In this second embodiment, therefore, the tap coefficient in the triple over-sampling/sub-pixel control processing unit 12 is switched by discerning the edge pattern of the occurrence of the jaggy to improve the jaggy effect and to reduce the color position shift in the vertical edge. In other words, to improve the color position shift, the edge pattern of the jaggy occurrence is judged and the tap coefficient in the triple over-sampling/sub-pixel control processing unit 12 is switched in accordance with the judgment result.

Referring to FIG. 8, the RGB signal inputted from the input terminal 1 is supplied to the triple over-sampling/sub-pixel control processing unit 12 and to a brightness signal generating unit 13. The brightness signal generating unit 13 generates a brightness signal Y from the RGB signal and a brightness edge detection/judgment unit 14 detects the existence/absence of the edge from this brightness signal Y and judges the kind of the edge. Here, an image memory 15 stores an edge pattern corresponding to the kind of the edge and a coefficient select signal S corresponding to this kind. When detecting the edge from the brightness signal Y, the edge detection/judgment unit 14 collates the edge pattern with the edge pattern stored in the image memory 15 to judge the kind of the edge, extracts the coefficient select signal S of the corresponding edge pattern and supplies it to the triple over-sampling/sub-pixel control processing unit 12. In this triple over-sampling/sub-pixel control processing unit 12, the tap coefficients K1(*n*) and K2(*n*) corresponding to the coefficient select signal S supplied are set to multipliers $\mathbf{6}R_1$ to $\mathbf{6}R_8$ and $\mathbf{6}B_1$ to $\mathbf{6}B_8$ (FIG. 3).

The brightness edge detection/judgment unit 14 has a memory that holds the brightness signal of one preceding line (horizontal scanning period), detects the existence/absence of the edge from the brightness signal of this one preceding line and the brightness signal of the line supplied at present (present line) and judges the kind of the edge in accordance with the mode of the existence of the detected edge.

Figure 9:
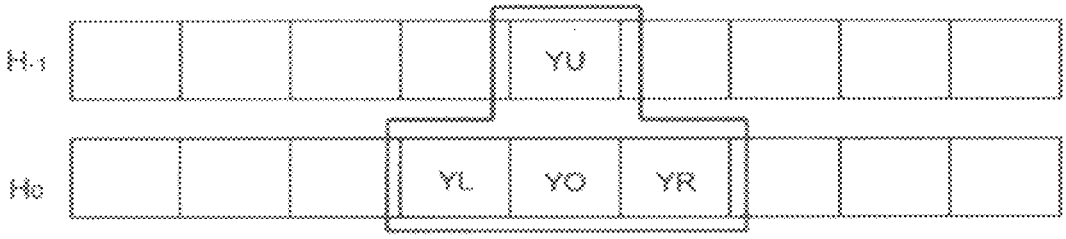
FIG. 9 shows an edge for judging the kind of an edge in a brightness edge detection/judgment unit.
Figure 9:
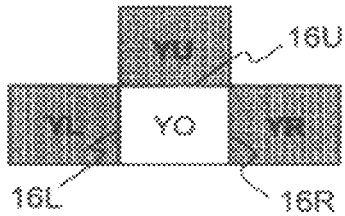

This will be explained with reference to FIG. 9. It will be assumed hereby that one pixel of the present line Ho is a pixel Y0 to be remarked as shown in FIG. 9(*a*) and that the preceding pixel (on the left side) of this remarked pixel Y0 on the present line H0 is a pixel YL, the succeeding pixel (on the right) of the pixel Y0 is YR, a pixel positioned at the same position (upper position) as the remarked pixel Y0 on a preceding line H-1 is a pixel YU and these pixels YL, YR and YU are comparative pixels for edge detection. Detection is then made about the existence of the edge 16L between the remarked pixel Y0 and the pixel YL, the existence of the edge 16R between the remarked pixel Y0 and the pixel YR and the existence of the edge 16U between the remarked pixel Y0 and the pixel YU as shown in FIG. 9(*b*). The kind of the edge (as to whether the edge is an oblique line edge or a longitudinal line edge) is judged from the combination of these edges 16L, 16R and 16U.

A detection method of the existence/absence of the edge judges that an edge exists between a remarked pixel Y0 and the comparative pixels YL, YR and YU when the following conditions are satisfied assuming that the pixel value of the remarked pixel Y0 is a remarked pixel value and the pixel values of the comparative pixels YL, YR and YL are comparative pixel values:

Condition 1:

$$|\text{comparative pixel value} - \text{remarked pixel value}| > \text{predetermined threshold value 1} \quad (3)$$

Condition 2:

$$\text{remarked pixel value} > \text{predetermined threshold value} \quad (4)$$

Here, the condition 2 takes into consideration the case where color position shift is remarkable when the remarked pixel Y0 is a pixel having brightness to a certain extent.

Figure 10:
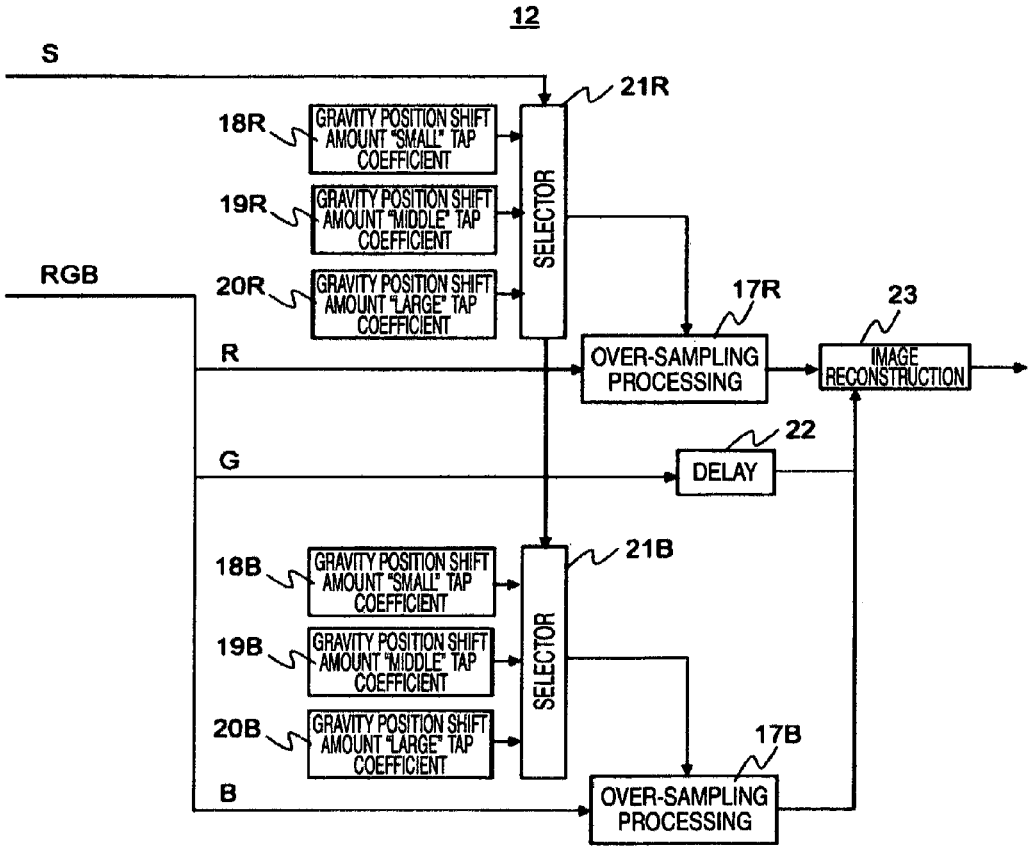
FIG. 10 is a block structural view showing a concrete example of a triple over-sampling/sub-pixel control processing unit shown in FIG. 8.

FIG. 10 is a block structural view showing a concrete example of the triple over-sampling/sub-pixel control processing unit 12 shown in FIG. 8. Reference numerals 17R and 17B denote triple over-sampling processing units. Reference numerals 18R, 18B, 19R, 19B, 20R and 20B denote tap coefficient holding units, respectively. Reference numerals 21R and 21B denote selectors. Reference numeral 22 denotes a delay unit and reference numeral 23 denotes a pixel reconstructing unit.

In the drawing, the tap coefficient holding unit 18R holds the tap coefficient of the triple over-sampling processing unit 17R for reducing the pixel gravity position shift amount (hereinafter called "pixel gravity position shift amount "small" tap coefficient"). The tap coefficient holding unit 20R holds the tap coefficient of the triple over-sampling processing unit 17R for increasing the pixel gravity position shift amount (hereinafter called "pixel gravity position shift amount "large" tap coefficient"). The tap coefficient holding unit 19R holds the tap coefficient of the triple over-sampling processing unit 17R for setting the pixel gravity position shift amount to an amount between the position shift amount by the pixel gravity position shift amount "small" tap coefficient and the position shift amount by the pixel gravity position shift amount "large" tap coefficient (this coefficient will be hereinafter called "pixel gravity position shift amount "middle" tap coefficient"). The pixel gravity position shift amount "small" tap coefficient, the pixel gravity position shift amount "large" tap coefficient and the pixel gravity position shift amount "middle" tap coefficient are selected by a selector 21R in accordance with the coefficient select signal S from the brightness edge detection/judgment unit 14 (FIG. 8) and are supplied to the triple over-sampling processing unit 17R.

Similarly, the tap coefficient holding unit 18B holds the tap coefficient of the triple over-sampling processing unit 17B for reducing the pixel gravity position shift amount (hereinafter called "pixel gravity position shift amount "small" tap coefficient"). The tap coefficient holding unit 20BR holds the tap coefficient of the triple over-sampling processing unit 17B for increasing the pixel gravity position shift amount (hereinafter called "pixel gravity position shift amount "large" tap coefficient"). The tap coefficient holding unit 19B holds the tap coefficient of the triple over-sampling processing unit 17B for setting the pixel gravity position shift amount to an amount between the position shift amount by the pixel gravity position shift amount "small" tap coefficient and the position shift amount by the pixel gravity position shift amount "large" tap coefficient (this coefficient will be hereinafter called "pixel gravity position shift amount "middle" tap coefficient"). The pixel gravity position shift amount "small" tap coefficient, the pixel gravity position shift amount "middle" tap coefficient and the pixel gravity position shift amount "large" tap coefficient are selected by a selector 21B in accordance with the coefficient select signal S from the brightness edge detection/judgment unit 14 (FIG. 8) and are supplied to the triple over-sampling processing unit 17B.

The R signal composed of the R sub-pixels inputted from the input terminal 1 is supplied to the triple over-sampling processing unit 17R. The B signal composed of the B sub-pixels is supplied to the triple over-sampling processing unit 17B and the G signal composed of the G sub-pixels is supplied to the delay unit 22. The triple over-sampling processing unit 17R has the construction similar to that of the triple over-sampling processing unit 2R shown in FIG. 3. The triple over-sampling processing unit 17B has the construction similar to that of the triple over-sampling processing unit 2B shown in FIG. 3. The delay unit 22 has the construction similar to that of the triple over-sampling processing unit 2 shown in FIG. 3.

Here, the pixel gravity position shift amount "small" tap coefficients in the tap coefficient holding units 18R and 18B are the tap coefficients K1(*n*) and K2(*n*) shown in Table 2. The pixel gravity position shift amount "large" tap coefficients in the tap coefficient holding units 20R and 20B are the tap coefficients K1(*n*) and K2(*n*) shown in Table 1. The pixel gravity position shift amount "middle" tap coefficients in the tap coefficient holding units 19R and 19B are the tap coefficients between the tap coefficients K1(*n*) and K2(*n*) shown in Table 1 and the tap coefficients K1(*n*) and K2(*n*) shown in Table 1. The degree of concentration of the values at the tap coefficients K1(*n*) and K2(*n*) or in other words, the degree of dispersion of the values to the tap coefficients other than the tap coefficients K1(0) and K2(0), is set between the pixel gravity position shift amount "small" tap coefficient and the pixel gravity position shift amount "large" tap coefficient.

Here, when the coefficient select signal S is outputted as the brightness edge detection/judgment unit 14 (FIG. 8) detects and judges the oblique edge, the selector 21R selects the pixel gravity position shift amount "large" tap coefficient in the tap coefficient holding unit 20R and supplies it to the triple over-sampling processing unit 17R, and the selector 21B selects the pixel gravity position shift amount "large" tap coefficient in the tap coefficient holding unit 20B and supplies it to the triple over-sampling processing unit 17R. Consequently, the tap coefficient K1($n$) shown in Table 1 is set to the multipliers $6R_1$ to $6R_8$ in FIG. 3 in the triple over-sampling processing unit 17R and the R(−⅓) sub-pixel the timing position of which is ahead by the ⅓ pixel cycle is generated and outputted for each R sub-pixel subjected to triple over-sampling. In the triple over-sampling processing unit 17B, the tap coefficient K2($n$) shown in Table 1 is set to the multipliers $6B_1$ to $6B_8$ in FIG. 3 and the B(+⅓) sub-pixel the timing position of which is ahead by the ⅓ pixel cycle is generated and outputted for each B sub-pixel subjected to triple over-sampling.

The R(−⅓) sub-pixel outputted from the triple over-sampling processing unit 17R and the B(+⅓) sub-pixel outputted from the triple over-sampling processing unit 17B are supplied to the image reconstruction unit 23 together with the G(0) sub-pixel delayed by the delay unit 22 and the processing in the sub-pixel control unit 3 explained previously with reference to FIG. 1 is executed.

When the coefficient select signal S is the one outputted as the brightness edge detection/judgment unit 14 (FIG. 8) detects and judges the edge in the longitudinal direction, the selector 21R selects the pixel gravity position shift amount "small" tap coefficient in the tap coefficient holding unit 18R and supplies it to the triple over-sampling processing unit 17R, and the selector 21B selects the pixel gravity position shift amount "small" tap coefficient in the tap coefficient holding unit 18B and supplies it to the triple over-sampling processing unit 17R.

Consequently, the tap coefficient K1($n$) shown in Table 2 is set to the multipliers $6R_1$ to $6R_8$ in FIG. 3 in the triple over-sampling processing unit 17R and the R(−⅛) sub-pixel the timing position of which is ahead by the ⅓ pixel cycle is generated and outputted for each R sub-pixel subjected to triple over-sampling. In the triple over-sampling processing unit 17B, the tap coefficient K2($n$) shown in Table 2 is set to the multipliers $6B_1$ to $6B_8$ in FIG. 3 and the B(+⅛) sub-pixel the timing position of which is ahead by the ⅓ pixel cycle is generated and outputted for each B sub-pixel subjected to triple over-sampling.

The R(−⅛) sub-pixel outputted from the triple over-sampling processing unit 17R and the B(+⅛) sub-pixel outputted from the triple over-sampling processing unit 17B are supplied to the image reconstructing unit 23 together with the G(0) sub-pixel delayed by the delay unit 22 and the processing in the sub-pixel control unit 3 explained previously with reference to FIG. 1 is executed.

When the coefficient select signal S is the one outputted as the brightness edge detection/judgment unit 14 (FIG. 8) detects and judges edges other than the edges in the oblique and longitudinal direction, the selector 21R selects the pixel gravity position shift amount "middle" tap coefficient in the tap coefficient holding unit 19R and supplies it to the triple over-sampling processing unit 17R, and the selector 21B selects the pixel gravity position shift amount "middle" tap coefficient in the tap coefficient holding unit 19B and supplies it to the triple over-sampling processing unit 17R. In the triple over-sampling processing unit 17R, an R sub-pixel the pixel gravity position shift amount of which is ahead by the ⅓ pixel cycle and is in between the R(−⅓) sub-pixel and the R(−⅛) sub-pixel is likewise generated and outputted. In the triple over-sampling processing unit 17B, a B sub-pixel the pixel gravity position shift amount of which is behind by the ⅓ pixel cycle and is in between the B(+⅓) sub-pixel and the B(+⅛) sub-pixel is likewise generated and outputted.

The R sub-pixel outputted from the triple over-sampling processing unit 17R and the B sub-pixel outputted from the triple over-sampling processing unit 17B are supplied to the image reconstruction unit 23 together with the G(0) sub-pixel delayed by the delay unit 22 and the processing in the sub-pixel control unit 3 explained previously with reference to FIG. 1 is executed.

Next, a judgment method of an edge in the brightness edge detection/judgment unit 14 will be explained.

The edge judgment method is conducted for the remarked pixel having brightness that satisfies the conditions (3) and (4) described above.

Figure 11:
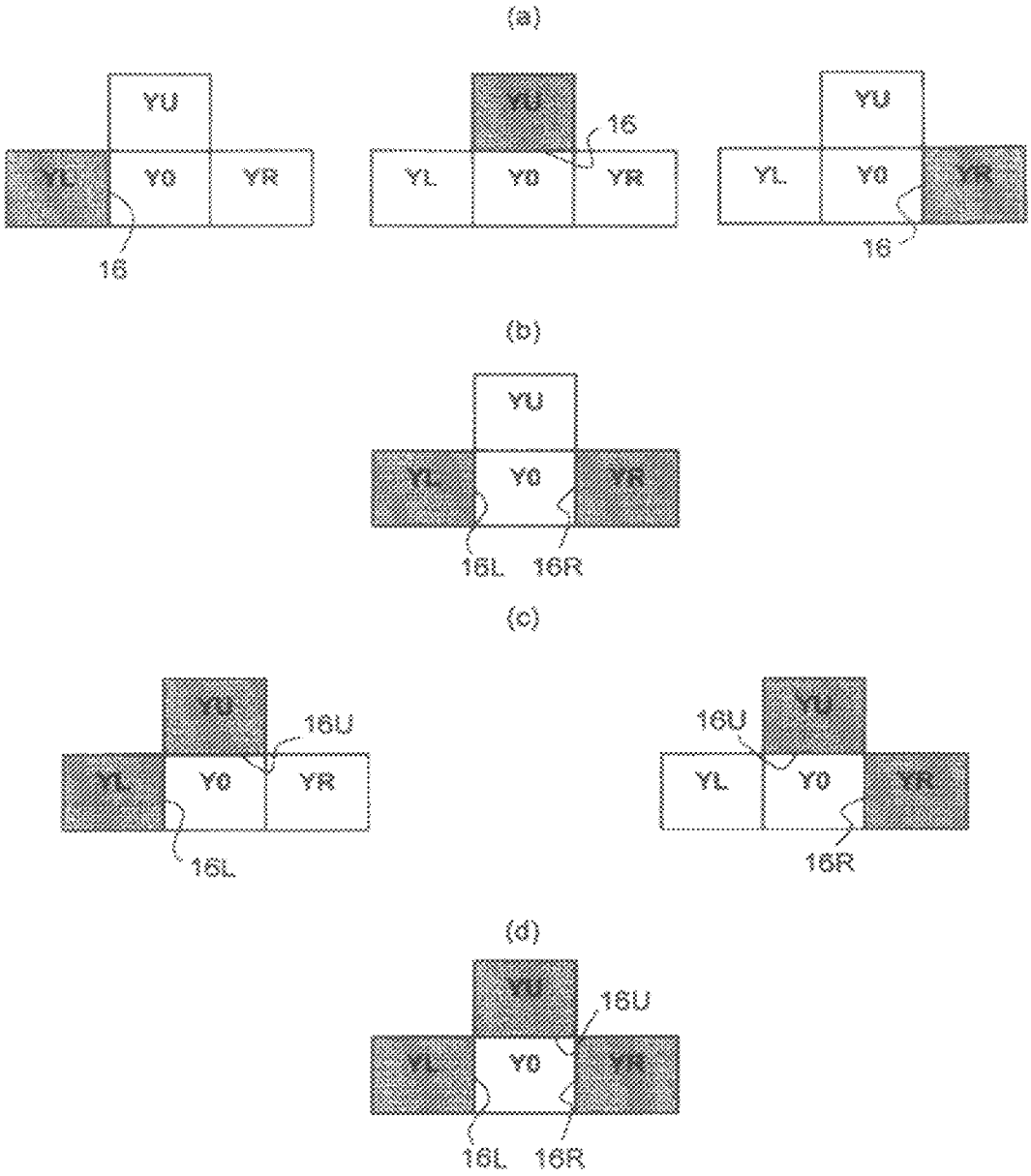
FIG. 11 shows a judgment method of the kind of the edge in the brightness edge detection/judgment unit shown in FIG. 8.

(1) When an edge exists between the remarked pixel Y0 and any one of the comparative pixels YL, YR and YU around the former as shown in FIG. 11($a$), the coefficient select signal S is used to select the pixel gravity position shift amount "middle" tap coefficient from the tap coefficient holding units 19R and 19B.

(2) When an edge 16L exists between the remarked pixel Y0 and the comparative pixel YL adjacent left to the former and moreover, when an edge 16R exists between the remarked pixel Y0 and the comparative pixel YR adjacent right to the former as shown in FIG. 11($b$), the coefficient select signal S is used to select the pixel gravity position shift amount "small" tap coefficient from the tap coefficient holding units 18R and 18B.

(3) In the cases other than the two cases described above, that is, when an edge L exists between the remarked pixel Y0 and the left adjacent comparative pixel YL and another edge 16U exists between the remarked pixel Y0 and the upper comparative pixel YU (of the preceding line) as shown in FIG. 11($c$) or when an edge 16L, 16R and 16U exists between the remarked pixel Y0 and each of all the surrounding comparative pixels YL, YR and YU as shown in FIG. 11($d$), the coefficient select signal S is used to select the pixel gravity position shift amount "large" tap coefficient from the tap coefficient holding units 20R and 20B.

(4) When no edge exists or when the remarked pixel fails to satisfy the conditions of the formulas (3) and (4), the coefficient select signal S is used to select the pixel gravity position shift amount "large" tap coefficient from the tap coefficient holding units 20R and 20B.

Such a rule employs a pixel gravity position shift amount "large" tap coefficient for an edge of a oblique line having an angle of inclination around 45 degrees to exploit maximum the jaggy improving effect. The pixel gravity position shift amount "middle" tap coefficient is used when the inclination angle of the edge is acute or mild and a pixel gravity position shift amount "middle" tap coefficient is used when the edge is a longitudinal line or a transverse line (longitudinal edge, transverse edge) to reduce maximum the false color.

As described above, the second embodiment can effectively reduce the jaggy at the edge in the oblique direction and color position shift at the edge in the longitudinal direction having the trade-off relation with the former.

Figure 12:
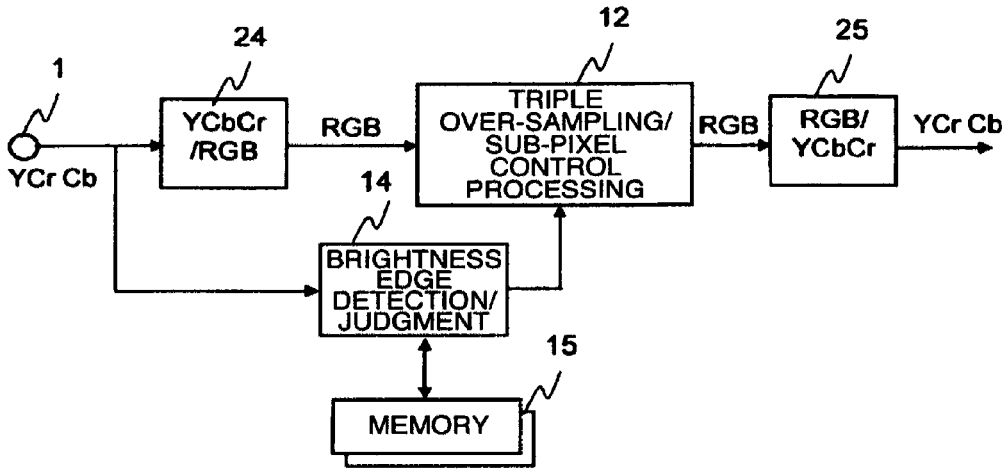
FIG. 12 is a block structural view of an image processing apparatus according to a third embodiment of the invention.

FIG. 12 is a block structural view showing an image processing apparatus according to the third embodiment of the invention. Reference numerals 24 and 25 denote signal converting units. Like reference numerals will be used to identify like constituents as in FIG. 8 and explanation of such members will be omitted.

In the drawing, a brightness signal Y, an R-Y color difference signal Cr and a B-Y color difference signal Cb are inputted from the input terminal 1. The brightness signal Y and the color difference signals Cr and Cb are supplied to the signal converting unit 24 and are converted to an RGB signal. This RGB signal is supplied to the triple over-sampling/sub-pixel control processing unit 12. The brightness signal Y inputted is also supplied to the brightness edge detection/judgment unit 15 to generate the coefficient select signal S in the same way as in the second embodiment shown in FIG. 8.

The coefficient select signal S is supplied to the triple over-sampling/sub-pixel control processing unit 12.

In the triple over-sampling/sub-pixel control processing unit 12, the processing operation similar to that of the triple over-sampling/sub-pixel control processing unit 12 shown in FIG. 8 is executed and the RGB signal outputted is supplied to the signal converting unit 25 and is converted to the brightness signal Y and the color difference signals Cr and Cb.

As described above, when the input signals are the brightness signal Y and the color difference signals Cr and Cb, too, the jaggy at the edge in the oblique direction can be reduced in the same way as in the second embodiment and color position shift at the edge in the longitudinal direction can be reduced, too.

In the second and third embodiments described above, pixel gravity position shift is always made in all the cases but the invention is not particularly limited thereto. When the edge has an acute angle of inclination or when the inclination is extremely gentle, for example, pixel gravity position shift need not always be made. In this case, the tap coefficients K1(0) and K2(0) in the triple over-sampling processing units 2R and 2B are set to 1 and other tap coefficients K1(*n*) and K2(*n*) are set to 0.

Explanation will be given in further detail. For example, the brightness edge detection/judgment unit 14 judges in which direction a pixel having an edge component (edge component greater than a predetermined level) is formed in a predetermined region (10 pixels in horizontal direction and 10 pixels in vertical direction, for example). The coordinates of each pixel having an edge component in this square region are detected and a linear function approximate to a segment formed by a plurality of pixels of the edge component is calculated by using the coordinate values. The segment expressed by this linear function is regarded as the segment constituted by a plurality of edge components (hereinafter called "edge segment") and an angle between the edge segment and the vertical or horizontal line is determined.

When the sub-pixel processing is executed to reduce the jaggy of the oblique line as described above, color position shift is likely to occur on such an oblique line. The jaggy of the oblique line reaches maximum when the angle with respect to the vertical or horizontal line is 45 degrees. In this embodiment, therefore, the angle between the edge segment determined in the manner described above and the vertical or horizontal line is determined by the brightness edge detection/judgment unit 14. When the angle between the edge segment and the vertical line (or horizontal line) is 45 degrees, the brightness edge detection/judgment unit 14 controls the triple over-sampling/sub-pixel control processing unit 12 by using the tap coefficient tabulated in Table 1 so that the pixel gravity position shift amount becomes maximal. Consequently, color position shift of the oblique line (edge) can be reduced.

When the angle between the edge segment and the vertical line (or the horizontal line) is 0 degree (that is, when the edge segment is equal to the vertical line (or horizontal line)), jaggy need not be taken into consideration. If the over-sampling processing is executed in such a case, color position shift of the edge becomes remarkable in some cases. In such a case, therefore, the over-sampling processing is not executed. For example, the values of the tap coefficients are controlled so that the tap coefficient K1(0) for the R(0) sub-pixel and the tap coefficient K2(0) for the B(0) sub-pixel are 1 and other tap coefficients become all 0. In this way, the pixel gravity position shift amount becomes 0 or minimal when the angle between the edge segment and the vertical line (or horizontal line) is 0 degree.

As the edge segment approaches the vertical line (or horizontal line) from the angle of 45° (that is, approaches the angle of 0°), color position shift owing to the sub-pixel processing becomes gradually smaller. Therefore, it is preferred to change the value of the tap coefficient in accordance with the angle between the edge segment and the vertical line (or horizontal line). For example, as the edge segment approaches the vertical line (or horizontal line) from the angle of 45°, the values of the tap coefficients for the center (R(0), B(0)) are increased and the values of the tap coefficients of the sub-pixels (R(4), R(−4), B(4), B(−4), etc) away from the center are decreased. Consequently, the closer the edge segment to the vertical line (or horizontal line), the pixel gravity position shift amount is set to a smaller value. (In other words, closer to 45°, the greater becomes the pixel gravity position shift amount).

According to the construction described above, the pixel gravity position shift amount can be controlled in accordance with the angle of the edge segment and color position shift of the edge can be reduced more appropriately while the jaggy of the oblique line is reduced.

As described above, in the second embodiment and its modified embodiment, the tap coefficient used for the over-sampling processing is adaptively switched in accordance with brightness edge information of the input image signal. In consequence, jaggy and color position shift at the edge can be reduced while the effect of apparently improving the high resolution by the image interpolation processing in the sub-pixel unit is maintained.

Figure 13:
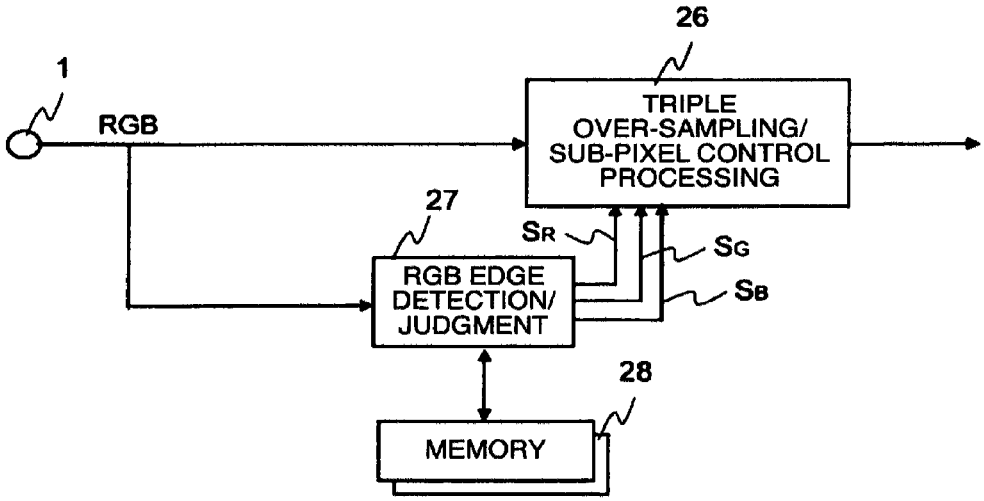
FIG. 13 is a block structural view of an image processing apparatus according to a fourth embodiment of the invention.

FIG. 13 is a block structural view showing an image processing apparatus according to the fourth embodiment of the invention. Reference numeral 26 denotes a triple over-sampling/sub-pixel control processing unit. Reference numeral 27 denotes an RGB edge detection/judgment unit. Reference numeral 28 denotes an image memory.

In the drawing, an RGB signal is inputted from an input terminal 1 and is supplied to both triple over-sampling/sub-pixel control processing unit 26 and RGB edge detection/judgment unit 27.

The RGB edge detection/judgment unit 27 detects an edge for each RGB signal, judges the kind of the edge detected and supplies a coefficient select signal for an R signal (coefficient select signal for R) $S_R$, a coefficient select signal for a G signal (coefficient select signal for G) $S_G$ and a coefficient select signal for B signal (coefficient select signal for B) $S_B$ to the triple over-sampling/sub-pixel control processing unit 26. Judgment of the kind of the detected edge for each RGB signal in the RGB edge detection/judgment unit 27 uses the judgment method, explained in FIG. 11, by the brightness edge detection/judgment unit 14 shown in FIG. 8. Therefore, the memory 28 stores a coefficient select signal corresponding to the kind of the edge (FIGS. 11(*a*) to 11(*d*)) for each of RGB (that is, coefficient select signal $S_R$ for R, coefficient select signal $S_G$ for G and coefficient select signal $S_B$ for B).

In the triple over-sampling/sub-pixel control processing unit 26, the triple over-sampling processing corresponding to the coefficient select signal $S_R$ for R, the coefficient select signal $S_G$ for G and the coefficient select signal $S_B$ for B from the RGB edge detection/judgment unit 27, that is, the pixel gravity position shift processing in the ⅓ pixel unit, is executed in the sub-pixel unit for each of the RGB signals.

In the embodiment shown in FIG. 8 and the third embodiment shown in FIG. 12, the edge is detected by using the brightness signal alone. Therefore, the edge cannot be grasped in the images containing large amounts of B (Blue) having small brightness components among the RGB components and there is the possibility that the intended control is not executed. In R (Red), too, the brightness component is not much contained, either, and the same discussion may also hold true. Since the edge detection/judgment processing is carried out for each RGB in this fourth embodiment, however, accuracy of the edge information detected can be improved. Since the edge coefficient used in the sub-pixel unit for each RGB can be set in the triple over-sampling/sub-pixel control processing unit 26, the edge coefficient can be set more flexibly in accordance with accuracy of the detected edge information, and the jaggy improving effect and the false color decreasing effect can be expected.

Figure 14:
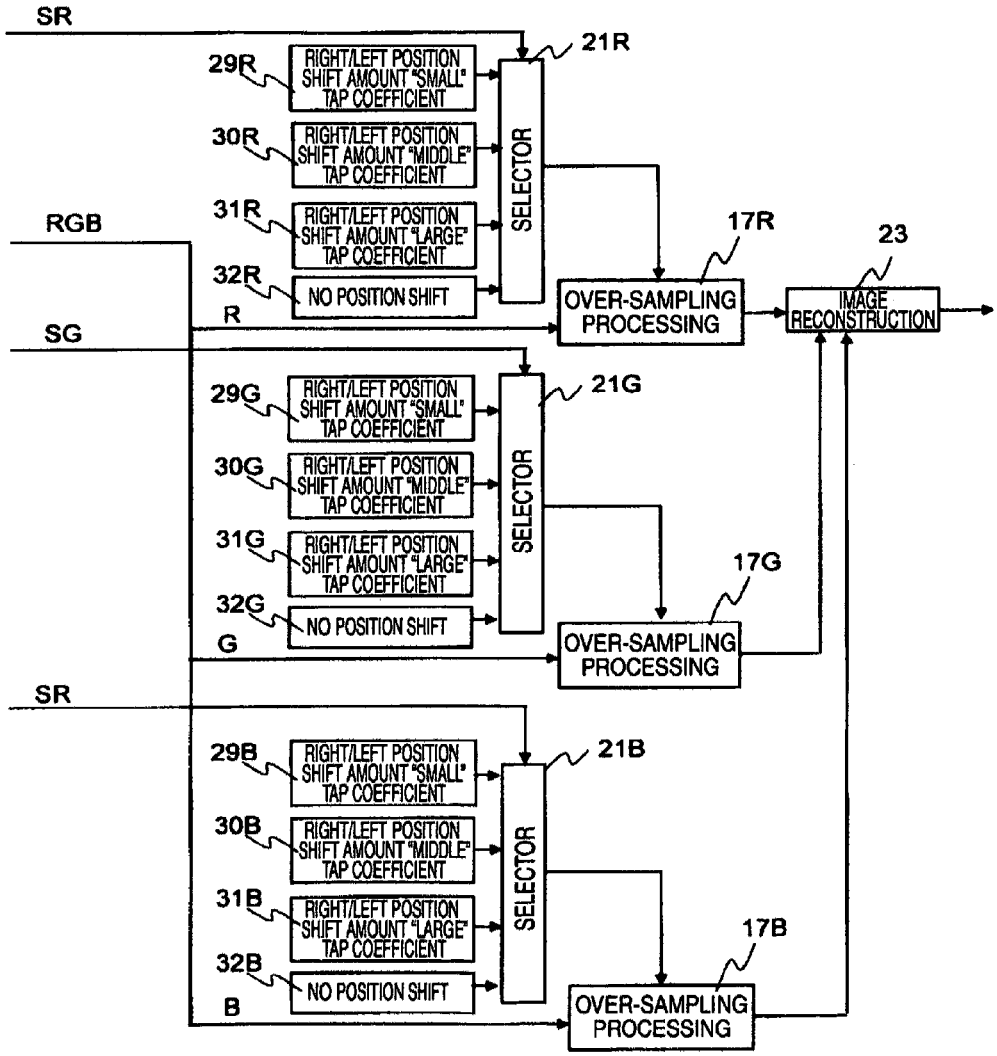
FIG. 14 is a block structural view showing a concrete example of a triple over-sampling/sub-pixel control processing unit in FIG. 13

FIG. 14 is a block structural view showing a concrete example of the triple over-sampling/sub-pixel control processing unit 26. Reference numeral 17G denotes a triple over-sampling processing unit of a G sub-pixel. Reference numeral 21G denotes a selector. Reference numerals 29R, 29G, 29B, 30R, 30G, 30B, 31R, 31G, 31B, 32R, 32G and 32B denote tap coefficient holding units, respectively. Like reference numerals will be used to identify like constituents as in FIG. 10 and repletion of explanation of such members will be omitted.

In the drawing, the tap coefficient holding unit 29R holds the tap coefficient for reducing the pixel gravity position shift amount in the left direction for the R sub-pixel (hereinafter called "left-hand pixel gravity position shift amount "small" tap coefficient") and the tap coefficient for reducing the pixel gravity position shift amount in the right direction ("right-hand pixel gravity position shift amount "small" tap coefficient"). The tap coefficient holding unit 30R holds the tap coefficient for setting the pixel gravity position shift amount in the left direction for the R sub-pixel to a middle (left-hand pixel gravity position shift amount "middle" tap coefficient) and the position shift amount in the right direction to a middle (right-hand pixel gravity position shift amount "middle" tap coefficient). The tap coefficient holding unit 31R holds the tap coefficient for increasing the pixel gravity position shift amount in the left direction for the R sub-pixel (left-hand pixel gravity position shift amount "large" tap coefficient) and the pixel position shift amount in the right direction (right-hand pixel gravity position shift amount "large" tap coefficient). The tap coefficient holding unit 32R holds a tap coefficient for setting the pixel gravity position shift amount to 0 for the R sub-pixel (pixel gravity position shift amount "zero" tap coefficient).

The tap coefficient is selected by any of the tap coefficient holding units 29R, 30R, 31R and 32R in accordance with the coefficient select signal $S_R$ for R from the RGB edge detection/judgment unit 27 (FIG. 13), is supplied to the triple over-sampling processing unit 17R and is set to its multiplier. The tap coefficient holding units 29R, 30R, 31R and 32R hold the tap coefficients of the left-hand pixel gravity position shift amounts and the tap coefficients of the right-hand pixel gravity position shift amounts, and any of these tap coefficients is selected in accordance with the coefficient select signal $S_R$ for R and is set to the multiplier. Therefore, the pixel gravity position shift direction of the R sub-pixel can be decided, too.

The tap coefficient holding unit 29B holds the tap coefficient for reducing the pixel gravity position shift amount in the left direction for the R sub-pixel ("left-hand pixel gravity position shift amount "small" tap coefficient") and the tap coefficient for reducing the pixel gravity position shift amount in the right direction ("right-hand pixel gravity position shift amount "small" tap coefficient"). The tap coefficient holding unit 30B holds the tap coefficient for setting the pixel gravity position shift amount in the left direction for the R sub-pixel to a middle (left-hand pixel gravity position shift amount "middle" tap coefficient) and the position shift amount in the right direction to a middle (right-hand pixel gravity position shift amount "middle" tap coefficient). The tap coefficient holding unit 31B holds the tap coefficient for increasing the pixel gravity position shift amount in the left direction for the R sub-pixel (left-hand pixel gravity position shift amount "large" tap coefficient) and the pixel position shift amount in the right direction (right-hand pixel gravity position shift amount "large" tap coefficient). The tap coefficient holding unit 32B holds a tap coefficient for setting the pixel gravity position shift amount to 0 for the R sub-pixel (pixel gravity position shift amount "zero" tap coefficient).

The tap coefficient is selected by any of the tap coefficient holding units 29B, 30B, 31B and 32B in accordance with the coefficient select signal $S_B$ for B from the RGB edge detection/judgment unit 27 (FIG. 13), is supplied to the triple over-sampling processing unit 17B and is set to its multiplier. The tap coefficient holding units 29B, 30B, 31B and 32B hold the tap coefficients of the left-hand pixel gravity position shift amounts and the tap coefficients of the right-hand pixel gravity position shift amounts, and any of these tap coefficients is selected in accordance with the coefficient select signal $S_B$ for B and is set to the multiplier. Therefore, the pixel gravity position shift direction of the B sub-pixel can be decided, too.

The fourth embodiment further includes the tap coefficient holding unit 29B that holds a tap coefficient for reducing the pixel gravity position shift amount in the left direction for the G sub-pixel ("left-hand pixel gravity position shift amount "small" tap coefficient") and a tap coefficient for reducing the pixel gravity position shift amount in the right direction ("right-hand pixel gravity position shift amount "small" tap coefficient"), a tap coefficient holding unit 30G holding a tap coefficient for setting the pixel gravity position shift amount in the left direction for the G sub-pixel to a middle (left-hand pixel gravity position shift amount "middle" tap coefficient) and a position shift amount in the right direction to a middle (right-hand pixel gravity position shift amount "middle" tap coefficient), a tap coefficient holding unit 31G holding a tap coefficient for increasing the pixel gravity position shift amount in the left direction for the G sub-pixel (left-hand pixel gravity position shift amount "large" tap coefficient) and a pixel position shift amount in the right direction (right-hand pixel gravity position shift amount "large" tap coefficient), and a tap coefficient holding unit 32G holding a tap coefficient for setting the pixel gravity position shift amount to 0 for the G sub-pixel (pixel gravity position shift amount "zero" tap coefficient).

The selector 21G selects the tap coefficient from any of the tap coefficient holding units 29G, 30G, 31G and 32G in accordance with the coefficient select signal $S_G$ for G from the RGB edge detection/judgment unit 27 (FIG. 13), and the coefficient so selected is supplied to the triple over-sampling processing unit 2R shown in FIG. 3 or the triple over-sampling processing unit 16G having the same construction as the triple over-sampling processing unit 2B and is set to its multiplier. The tap coefficient holding units 29G, 30G, 31G and 32G hold the tap coefficients of the left-hand pixel gravity position shift amounts and the tap coefficients of the right-hand pixel gravity position shift amounts, and any of these tap coefficients is selected in accordance with the coefficient select signal $S_G$ for G and is set to the multiplier of the triple over-sampling processing unit 17G. Therefore, the pixel gravity position shift direction of the G sub-pixel can be decided besides the pixel gravity position shift amount, too.

The R sub-pixel outputted from the triple over-sampling processing unit 17R, the G sub-pixel outputted from the triple over-sampling processing unit 17G and the B sub-pixel outputted from the triple over-sampling processing unit 17B are supplied to the pixel reconstruction unit 23.

As described above, the fourth embodiment detects the edge in the RGB sub-pixel unit, sets the edge coefficient for each RGB sub-pixel in accordance with the edge information, sets the pixel gravity position shift amount in accordance with the edge information and can also set the position shift direction, too. Therefore, more optimal control of the sub-pixels can be made in accordance with the features of the input image and images having higher resolution and less jaggy and color position shift resulting from the edge can be acquired.

Incidentally, the tap coefficients for deciding the pixel gravity position shift amount are set to the pixel gravity position shift amount "small", "middle", "large" and "zero" for all the RGB sub-pixels in FIG. 14 but this is not particularly restrictive. In other words, the pixel gravity position shift amount that can be selected for each RGB pixel may be made different.

It is possible to select the tap coefficient of the left-hand pixel gravity position shift amount for the R sub-pixels and the tap coefficient for the right-hand pixel gravity position shift amount for the B sub-pixels in a display panel having an RGB arrangement for the RGB sub-pixels, and to select the tap coefficient of the right-hand pixel gravity position shift amount for the R sub-pixels and the tap coefficient for the left-hand pixel gravity position shift amount for the B sub-pixels in a display panel having a BGR arrangement for the RGB sub-pixels, as an example of selection of the tap coefficients. In either case, it may be possible to respectively select the tap coefficient of the pixel gravity position shift amount in a direction corresponding to the position of the edge detected, for the G-sub-pixels.

Each of the foregoing embodiments has been explained about the example of the triple over-sampling processing using the ⅓ pixel clock of ⅓ times the pixel cycle. However, it is also possible to use an n-times over-sampling processing using a 1/n pixel clock with n representing an integer or 3 or more and to displace the timing positions of the sub-pixels by ±1/n pixel.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An image processing apparatus for a displaying device in which three light emitting devices respectively emitting light of RGB primary colors constitute one pixel, comprising:

an edge detection/determination unit which detects an edge around a remarked pixel and determines a type of the detected edge to output edge information;

an n-times over-sampling processor (where n is an integer of 3 or more) which executes an n-times over-sampling processing for each RGB sub-pixel;

a sub-pixel controller which reconstructs one original image from the RGB sub-pixels subjected to said n-times over-sampling processing; and wherein for each of R sub-pixel and B sub-pixel, said n-times over-sampling processor adaptively switches a pixel gravity position shift amount relative to G sub-pixel in accordance with the edge information detected and determined by said edge detection/determination unit.

2. The image processing apparatus according to claim 1, wherein said sub-pixel controller controls a pixel gravity position shift amount in a 1/n pixel unit in accordance with the RGB pixel subjected to said n-times over-sampling processing.

3. The image processing apparatus according to claim 1, wherein n=3.

4. The image processing apparatus according to claim 1, wherein said edge detection/judgment unit detects an edge between the remarked pixel and comparative pixels adjacent to the remarked pixel in horizontal and vertical directions, and judges the kind of the edge detected.

5. The image processing apparatus according to claim 1, wherein said edge detection/judgment unit executes edge detection/judgment by using pixels of a brightness signal.

6. The image processing apparatus according to claim 1, wherein said edge detection/judgment unit executes edge detection/judgment for each RGB signal.

7. The image processing apparatus according to claim 1, wherein said edge detection/judgment unit executes detection of the existence/absence of the edge based on a predetermined threshold value as a reference.

8. The image displaying device having mounted thereto said image processing apparatus according to claim 1.

* * * * *